US011371369B2

(12) United States Patent
Edwards et al.

(10) Patent No.: US 11,371,369 B2
(45) Date of Patent: Jun. 28, 2022

(54) VANES AND SHROUDS FOR A TURBO-MACHINE

(71) Applicant: Cummins Ltd., London (GB)

(72) Inventors: Matthew William Edwards, Huddersfield (GB); Karl Conlon, Huddersfield (GB); Simon David Moore, Huddersfield (GB); Christopher Parry, Huddersfield (GB); Andrew Sullivan, Huddersfield (GB); Paul Ghosh, Huddersfield (GB); Mark R. Holden, Huddersfield (GB); George E. Sandford, Huddersfield (GB); Nandakishore Arcot Madhusudan, Huddersfield (GB); Stephen David Hughes, Huddersfield (GB); Christopher J. Shaw, Huddersfield (GB)

(73) Assignee: CUMMINS LTD., London (GB)

( * ) Notice: Subject to any disclaimer, the term of this patent is extended or adjusted under 35 U.S.C. 154(b) by 0 days.

(21) Appl. No.: 17/055,485

(22) PCT Filed: May 15, 2019

(86) PCT No.: PCT/GB2019/051333
§ 371 (c)(1),
(2) Date: Nov. 13, 2020

(87) PCT Pub. No.: WO2019/220112
PCT Pub. Date: Nov. 21, 2019

(65) Prior Publication Data

US 2021/0363891 A1 Nov. 25, 2021

(51) Int. Cl.
*F01D 17/14* (2006.01)
*F01D 9/04* (2006.01)
(Continued)

(52) U.S. Cl.
CPC ..... *F01D 9/04* (2013.01); *F01D 17/143* (2013.01); *F01D 17/167* (2013.01); *F02B 37/22* (2013.01);
(Continued)

(58) Field of Classification Search
CPC ..... F01D 17/143; F01D 17/167; F01D 17/14; F01D 17/16; F02B 37/22
See application file for complete search history.

(56) References Cited

U.S. PATENT DOCUMENTS 8,172,516 B2 * 5/2012 Parker ..... F01D 17/143 415/151
8,221,059 B2 * 7/2012 Brown ..... F01D 17/167 415/158
(Continued)

FOREIGN PATENT DOCUMENTS

GB 2462115 A 1/2010
GB 2525240 A 10/2015
(Continued)

OTHER PUBLICATIONS

International Search Report and Written Opinion, issued by the European Patent Office, dated Oct. 22, 2019, for International Application PCT/GB2019/051333; 17 pages.
(Continued)

*Primary Examiner* — Woody A Lee, Jr.
*Assistant Examiner* — Behnoush Haghighian
(74) *Attorney, Agent, or Firm* — Faegre, Drinker, Biddle & Reath, LLP

(57) ABSTRACT

A turbine for a turbo-machine is proposed in which, at a gas inlet for a turbine wheel, vanes extend from a nozzle ring though slots in a shroud. The nozzle ring and shroud are relatively rotatable about a rotational axis of the turbine by at least 0.1 degrees. In use, the nozzle ring and shroud are
(Continued)

relatively rotated to bring one side of the vane into close contact with one surface of the slot, to inhibit leakage of gas between the vane and the slot surface. For this purpose the respective surfaces of the nozzle and slot can be configured to closely conform to each other. If there is differential thermal expansion of the shroud and nozzle ring, the nozzle ring and shroud can relatively rotate, to withdraw the vane from the edge of the slot to relieve the pressure between them.

20 Claims, 15 Drawing Sheets

(51) Int. Cl.
*F01D 17/16* (2006.01)
*F02B 37/22* (2006.01)

(52) U.S. Cl.
CPC .... *F05D 2220/40* (2013.01); *F05D 2240/128* (2013.01)

(56) References Cited

U.S. PATENT DOCUMENTS 8,764,388 B2 * 7/2014 Roberts ..... F02B 37/24 415/158
9,404,383 B2 * 8/2016 Roberts ..... F02B 37/22
10,472,982 B2 * 11/2019 Khan ..... F01D 17/143
10,489,266 B2 * 11/2019 Wilkinson ..... G06F 11/3433
2008/0089782 A1 * 4/2008 Parker ..... F01D 17/143 415/150
2011/0076139 A1 * 3/2011 Brown ..... F01D 17/167 415/159
2011/0123316 A1 * 5/2011 Roberts ..... F02C 6/12 415/160
2014/0133969 A1 * 5/2014 Roberts ..... F02B 37/22 415/155
2014/0248138 A1 * 9/2014 Roberts ..... F01D 17/143 415/159
2015/0345376 A1 * 12/2015 Ibaraki ..... F02B 39/005 60/605.1
2016/0299827 A1 * 10/2016 Wilkinson ..... G06F 11/3433
2017/0067359 A1 * 3/2017 Khan ..... F01D 17/165

FOREIGN PATENT DOCUMENTS

WO 2009118528 A1 10/2009
WO 2015/094339 A1 6/2015
WO 2015094319 A1 6/2015
WO 2015/170106 A1 11/2015
WO 2015176106 A1 11/2015

OTHER PUBLICATIONS

Search Report issued by the United Kingdom Intellectual Property Office, dated Nov. 16, 2018, for United Kingdom Application No. GB1807881.6; 4 pages.
International Preliminary Report on Patentability issued by The International Bureau of WIPO, dated Nov. 17, 2020 for International Application No. PCT/GB2019/051333; 9 pages.
International Search Report and Written Opinion issued by the European Patent Office, dated Oct. 22, 2019, for International Application No. PCT/GB2019/051333; 13 pages. (Document previously submitted on Nov. 13, 2020).
International Preliminary Reporton Patentability received for PCT Patent Application No. PCT/GB2019/051333, dated Nov. 26, 2020, 10 pages.
International Search Report and Written Opinion received for PCT Patent Application No. PCT/GB2019/051333, dated Oct. 22, 2019, 13 pages.

* cited by examiner

VANES AND SHROUDS FOR A TURBO-MACHINE

CROSS-REFERENCE TO RELATED APPLICATIONS

The present application claims priority to PCT Application No. PCT/GB2019/051333, filed May 15, 2019, which claims priority to United Kingdom Patent Application No. 1807881.6, filed on May 15, 2018, the disclosures of which being expressly incorporated herein by reference.

FIELD OF THE DISCLOSURE

The present disclosure relates to vane arrangement for positioning at a gas inlet of a turbo-machine such as a turbo-charger.

BACKGROUND OF THE DISCLOSURE

Turbochargers are well-known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the inlet manifold of the engine, thereby increasing engine power. The turbocharger shaft is conventionally supported by journal and thrust bearings, including appropriate lubricating systems, located within a central bearing housing connected between the turbine and compressor wheel housing.

In known turbochargers, the turbine stage comprises a turbine chamber within which the turbine wheel is mounted; an annular inlet passage defined between facing radial walls arranged around the turbine chamber; an inlet arranged around the inlet passage; and an outlet passage extending axially from the turbine chamber. The passages and chambers communicate such that pressurised exhaust gas admitted to the inlet chamber flows through the inlet passage to the outlet passage via the turbine and rotates the turbine wheel.

It is known to improve turbine performance by providing vanes, referred to as nozzle vanes, in the inlet passage so as to deflect gas flowing through the inlet passage towards the direction of rotation of the turbine wheel. Each vane is generally laminar, and is positioned with one radially outer surface arranged to oppose the motion of the exhaust gas within the inlet passage, i.e. the radially inward component of the motion of the exhaust gas in the inlet passage is such as to direct the exhaust gas against the outer surface of the vane, and it is then redirected into a circumferential motion.

Turbines may be of a fixed or variable geometry type. Variable geometry type turbines differ from fixed geometry turbines in that the geometry of the inlet passage can be varied to optimise gas flow velocities over a range of mass flow rates so that the power output of the turbine can be varied to suit varying engine demands.

In one form of a variable geometry turbocharger, a nozzle ring carries a plurality of axially extending vanes, which extend into the air inlet, and through respective apertures ("slots") in a shroud which forms a radially-extending wall of the air inlet. The nozzle ring is axially movable by an actuator to control the width of the air passage. Movement of the nozzle ring also controls the degree to which the vanes project through the respective slots. The shroud is ring-shaped and encircles the rotational axis.

An example of such a variable geometry turbocharger is shown in FIGS. 1(*a*) and 1(*b*), taken from U.S. 8,172,516. The illustrated variable geometry turbine comprises a turbine housing 1 defining an inlet chamber 2 to which gas from an internal combustion engine (not shown) is delivered. The exhaust gas flows from the inlet chamber 2 to an outlet passage 3 via an annular inlet passage 4. The inlet passage 4 is defined on one side by the face of a movable annular wall member 5 which constitutes the nozzle ring, and on the opposite side by an annular shroud 6, which covers the opening of an annular recess 8 in the facing wall. The shroud 6 is a ring-shaped member (a one-piece unit) defining a central aperture and encircling the rotational axis. The facing wall is defined by a portion 28 of the turbine housing 1. The shroud 6 is connected to the portion 28 of the turbine housing 1 by a bracket 29 at the radially-outer side of the shroud 6. In some arrangements a retention ring (not shown) is provided partially inserted into a radially-outwardly facing recess in the bracket 29, and a radially outer portion of the retention ring is retained by the portion 28 of the turbine housing 1.

Gas flowing from the inlet chamber 2 to the outlet passage 3 passes over a turbine wheel 9 and as a result torque is applied to a turbocharger shaft 10 supported by a bearing assembly 14 that drives a compressor wheel 11. Rotation of the compressor wheel 11 about rotational axis 100 pressurizes ambient air present in an air inlet 12 and delivers the pressurized air to an air outlet 13 from which it is fed to an internal combustion engine (not shown). The speed of the turbine wheel 9 is dependent upon the velocity of the gas passing through the annular inlet passage 4. For a fixed rate of mass of gas flowing into the inlet passage, the gas velocity is a function of the width of the inlet passage 4, the width being adjustable by controlling the axial position of the nozzle ring 5. As the width of the inlet passage 4 is reduced, the velocity of the gas passing through it increases. FIG. 1(*a*) shows the annular inlet passage 4 closed down to a minimum width, whereas in FIG. 1(*b*) the inlet passage 4 is shown fully open.

The nozzle ring 5 supports an array of circumferentially and equally spaced vanes 7, each of which extends across the inlet passage 4. The vanes 7 are orientated to deflect gas flowing through the inlet passage 4 towards the direction of rotation of the turbine wheel 9. When the nozzle ring 5 is proximate to the annular shroud 6 and to the facing wall, the vanes 7 project through suitably configured slots in the shroud 6 and into the recess 8. Each vane has an "inner" major surface which is closer to the rotational axis 100, and an "outer" major surface which is further away. Both the nozzle ring 5 and the shroud 6 are at a fixed angular position about the axis 100. The vanes 7 are illustrated in FIGS. 1(*a*) and 1(*b*) as having a chamfered end portion (towards the right of the figures), but in most modern arrangements the vanes are either longitudinally symmetric along their whole length, or else composed of two sections which are each longitudinally symmetric but which have a different profile from each other as viewed in the axial direction.

A pneumatically or hydraulically operated actuator 16 is operable to control the axial position of the nozzle ring 5 within an annular cavity 19 defined by a portion 26 of the turbine housing via an actuator output shaft (not shown), which is linked to a stirrup member (not shown). The stirrup member in turn engages axially extending guide rods (not shown) that support the nozzle ring 5. Accordingly, by appropriate control of the actuator 16 the axial position of the guide rods and thus of the nozzle ring 5 can be controlled. It will be appreciated that electrically operated actuators could be used in place of a pneumatically or hydraulically operated actuator 16.

The nozzle ring 5 has axially extending inner and outer annular flanges 17 and 18 respectively that extend into the annular cavity 19, which is separated by a wall 27 from a chamber 15. Inner and outer sealing rings 20 and 21, respectively, are provided to seal the nozzle ring 5 with respect to inner and outer annular surfaces of the annular cavity 19, while allowing the nozzle ring 5 to slide within the annular cavity 19. The inner sealing ring 20 is supported within an annular groove 22 formed in the inner surface of the cavity 19 and bears against the inner annular flange 17 of the nozzle ring 5, whereas the outer sealing ring 21 is supported within an annular groove 23 provided within the annular flange 18 of the nozzle ring 5 and bears against the radially outermost internal surface of the cavity 19. It will be appreciated that the inner sealing ring 20 could be mounted in an annular groove in the flange 17 rather than as shown, and/or that the outer sealing ring 21 could be mounted within an annular groove provided within the outer surface of the cavity rather than as shown. A first set of pressure balance apertures 25 is provided in the nozzle ring 5 within the vane passage defined between adjacent apertures, while a second set of pressure balance apertures 24 are provided in the nozzle ring 5 outside the radius of the nozzle vane passage.

Note that in other known turbomachines, the nozzle ring is axially fixed and an actuator is instead provided for translating the shroud in a direction parallel to the rotational axis. This is known as a "moving shroud" arrangement.

In known variable geometry turbo-machines which employ vanes projecting through slots in a shroud, a clearance is provided between the vanes and the edges of the slots to permit thermal expansion of the vanes as the turbocharger becomes hotter. As viewed in the axial direction, the vanes and the slots have the same shape, but the vanes are smaller than the slots. In a typical arrangement, the vanes are positioned with an axial centre line of each vane in a centre of the corresponding slot, such that in all directions away from the centre line transverse to the axis of the turbine, the distance from the centre line to the surface of the vane is the same proportion of the distance from the centre line to the edge of the corresponding slot. The clearance between the vanes and the slots is generally arranged to be at least about 0.5% of the distance of a centre of the vanes from the rotational axis (the "nozzle radius") at room temperature (which is here defined as 20 degrees Celsius) around the entire periphery of the vane (for example, for a nozzle radius of 46.5 mm the clearance may be 0.23 mm, or 0.5% of the nozzle radius). This means that, if each of the vanes gradually thermally expands perpendicular to the axial direction, all points around the periphery of the vane would touch a corresponding point on the slot at the same moment. At all lower temperatures, there is a clearance between the entire periphery of the vane and the edge of the corresponding slot.

SUMMARY OF THE DISCLOSURE

The present disclosure aims to provide new and useful vane assemblies for use in a turbo-machine, as well as new and useful turbo-machines (especially turbo-chargers) incorporating the vane assemblies.

In an earlier patent application (GB 1619347.6, which was unpublished at the priority date of the present application), the present applicant proposed that in the turbine of a turbomachine of the kind in which, at a gas inlet between a nozzle ring and a shroud, vanes project from the nozzle through slots in the shroud, one "conformal" portion of a lateral surface of each vane (i.e. a surface including a direction parallel to the rotational axis) substantially conforms to the shape of a corresponding "conformal" portion of a lateral surface of the corresponding slot at room temperature, so as to enable the respective conformal portions of the surfaces to be placed relative to each other with only a small clearance between them. An advantage of this is that gas flow between the respective conformal portions of the surfaces of the vane and the slot can be substantially reduced. This reduces leakage of gas into or out of a recess on the other side of the shroud from the nozzle ring. Such leakage reduces the circumferential redirection of the gas caused by the vanes, and has been found to cause significant losses in efficiency.

In such an arrangement, the conformal portions of the vane surface and slot surface can be positioned close to each other, or even in contact, at low temperature (such as room temperature). At higher temperatures, if the shroud and nozzle ring expand uniformly, this contact is maintained. However, uneven thermal expansion of the components of the turbine in use may cause the vanes and the slots to press against one another, making it harder to move the vanes axially relative to the slots. To some extent this effect may be reduced by any free play in the mounting of the shroud and nozzle ring, which permits the vane to retract away from the inner surface of the shroud, to prevent the respective surfaces being pressed together with high force. Any such free play is not due to design but rather the result of tolerances in the formation of components. It varies from one turbomachine to another, and the present inventors have found experimentally that such free play permits relative rotation of the nozzle ring with respect to the shroud by significantly less than 0.1 degrees, e.g. up to 0.05 degrees.

In general terms, the present disclosure proposes that a turbine (for example of a turbo-charger) permits the nozzle ring to move relative to the shroud in the circumferential direction by a larger angular amount (at least 0.1 degrees), to relieve pressure between the vanes and the edges of the respective slots.

A specific expression of the disclosure is a turbine comprising:

(i) a turbine wheel having an axis, (ii) a turbine housing for defining a chamber for receiving the turbine wheel for rotation of the turbine wheel about an axis, the turbine housing further defining a gas inlet, and an annular inlet passage from the gas inlet to the chamber, (iii) a ring-shaped shroud defining a plurality of slots and encircling the axis; and (iv) a nozzle ring supporting a plurality of vanes which extend from the nozzle ring parallel to the axis, and project through respective ones of the slots;

the shroud and nozzle ring being positioned on opposite sides of the inlet passage and rotatable relative to each other about the axis by an angular amount of at least 0.1 degrees.

The shroud and nozzle are each supported within the turbine housing, but, in one possibility, at least one of the shroud and the nozzle is rotatable relative to the turbine housing about the axis by at least 0.1 degree. Typically, the other of the shroud and nozzle is mounted on the turbine housing such that it is angularly rotatable about the axis with respect to the housing by an amount less than 0.1 degree.

The concept of arranging for the nozzle ring to be rotatable relative to the shroud is referred to here as "clocking".

Typically, the nozzle ring and shroud are relatively rotatable about the axis of the turbine by at least 0.3 degrees, at least 0.5 degrees, at least 1 degree, at least 1.5 degrees, or at least 2 degrees.

We refer to a connection between the turbine housing and either the shroud or nozzle ring which permits relative rotation respectively of the shroud or nozzle ring with respect to the turbine housing by at least 0.1 degree, as a coupling mechanism.

In one possibility, the coupling mechanism may substantially fix the axial position of the shroud/nozzle ring, and/or maintain a centre of the shroud/nozzle substantially on the axis of the turbine wheel, but may permit the shroud/nozzle ring to rotate about the axis of the turbine wheel relative to the turbine housing. The coupling mechanism may permit rotation of the shroud/nozzle ring relative to the turbine housing through a fixed range of angles which is at least 0.1 degree, or freely (i.e. by an unlimited angular amount). In the latter case the rotation of the shroud/nozzle ring relative to the turbine housing may be limited only by interaction between the vanes of the nozzle ring and the slots of the shroud.

The turbine preferably further includes an actuator for displacing one of the nozzle ring or shroud axially with respect to the other. The actuator may be typically mounted on the turbine housing. In one possibility, the coupling mechanism couples the nozzle ring or the shroud to the turbine housing via the actuator.

In a first possibility, the coupling mechanism connects the actuator to the nozzle ring, while permitting the nozzle ring to move rotationally relative to the actuator. The shroud may be substantially fast with (that is, in mounted in fixed positional relationship with) a housing of the turbo-machine. The turbine housing may comprise a limit element which bears against a circumferentially-facing surface of the shroud and limits rotation of the shroud about the axis. The limit element may for example be provided as a pin element which projects from the turbine housing, the shroud having a wall defining a gap containing the pin element. A circumferentially-facing surface of the wall may bear against the pin element in use to limit rotational motion of the shroud.

The coupling mechanism may include at least one guide coupling. Each guide coupling may include: (i) a first element fast with one of the nozzle ring and actuator, and (ii) a second element fast with the other of the nozzle ring and actuator, and being arranged to move within a limited region defined by the first element. The region may be sized to permit the second element to rotate circumferentially relative to the first element about the axis by at least 0.1 degrees. For example, the first element may define a control surface extending in a circumferential direction about the axis (e.g. an edge of an elongate circumferential slot), and the second element being arranged to move along a path defined by the control surface. The path may be at least 0.1 degrees in length. In a variation, the region may be defined by an aperture which is large enough to permit the rotational motion, but which does not include a control surface to guide the rotation to be along a path.

In a second possibility, the coupling mechanism connects the actuator to the shroud, while permitting the shroud to move rotationally relative to the actuator.

A rotation mechanism is provided for urging the shroud and nozzle ring to rotate relatively around the axis in a predefined sense. In principle, the rotation mechanism may comprise an externally-controllable actuator. In other possibilities the rotation mechanism could be provided comprising at least one resilient spring element, and/or at least one magnetic element. The rotation mechanism may urge lateral surfaces of the vanes and respective lateral surfaces of respective slots against each other, thereby reducing gas flow between those surfaces. This is particularly, but not exclusively, useful if the lateral surfaces of the vanes and the respective slots conform to each other closely in shape.

In a preferred case, the rotation mechanism comprises gas interaction elements on one of the shroud and the nozzle, arranged to develop a rotational force in use due to flow of the gas against the gas interaction elements. The vanes themselves may serve as gas interaction elements for urging the nozzle ring to rotate relative to the turbine housing, so that no additional rotation mechanism is required.

In the case of gas interaction element(s) provided on the shroud, one or more of the gas interaction element(s) may be on a face of the shroud opposite to the nozzle ring.

If a face of the shroud includes a land surface (e.g. a surface which is transverse to the rotational axis), the gas interaction element(s) may, for example, include a respective ridge element of the face of the shroud which is upstanding from (e.g. further away from the nozzle ring than) the land surface. The ridge element(s) may be elongate. The ridge element(s) may comprise a top surface which is substantially transverse to the axial direction, and/or two opposed wall surfaces which include the axial direction. Typically, rotational force is developed due to flow of the gas against one of the wall surfaces. Additionally, rotational force is developed by flow of the gas against other surfaces of the shroud, such as the inwardly facing surfaces of the slot which extend between the faces of the shroud and which define the edge of the slot. The net rotational force on the shroud is the sum of the rotational forces imparted by the gas onto all the surfaces of the shroud.

At least one respective ridge element may be provided for one or more of the slots of the shroud, such as each of the slots. A respective ridge element for a slot may have a shape matching a shape of an edge of the slot. A respective ridge element for a slot may be provided proximate an edge of the slot, for example within a distance from the slot about the rotational axis of less than 250 microns, or less than 100 microns. Indeed, an axially extending surface of the raised portion may be substantially flush with an inwardly facing surface of the slot which defines the edge of the slot. For example, it may be a continuous axial extension of a portion of the inwardly-facing surface of the slot (i.e. a projected slot surface).

Some or all of the ridge elements may extend radially inward of a radially inward end of the slot, for example to join an inner rim portion of the shroud face which is upstanding from the land surface and encircles the rotational axis radially inwardly of the slots. Alternatively or additionally, some or all of the ridge elements may extend radially outward of a radially outward end of the slot, for example so as to join (e.g. be formed integrally with) an outer rim portion of the shroud face which is upstanding from the land surface and encircles the rotational axis radially outwardly of the slots. In this case, the ridge elements partition the land surface of the shroud into respective portions of each of the slots.

The inner and/or outer rim(s) may be considered as rib elements (i.e. upstanding elements which extend circumferentially to join a plurality of the ridge elements). The ridge elements may be connected together by other rib element(s) upstanding from the face of the shroud. The rib element(s)

may make the ridge elements easier to form with high precision, since, if corresponding rib elements connect to one or both ends of the ridge elements, it may be unnecessary to form corners for the ridge elements at their ends.

As noted above, it is preferable if a portion of the surface of each vane is conformal with an opposed portion of the surface of the respective slot, where the two conformal portions of the respective surfaces are urged together by the rotation mechanism. In one specific expression of this concept, each of the vanes has an axially-extending vane surface which includes (i) a vane outer surface facing an outer surface of the corresponding slot, (ii) an opposed vane inner surface facing an inner surface of the corresponding slot. The vane further includes a median line between the vane inner surface and the vane outer surface extending from a first end of the vane to a second end of the vane. The vane surface includes a conformal portion, extending along at least 15% of the length of the median line, and facing a corresponding conformal portion of the slot surface, wherein, at room temperature, the respective profiles of the conformal portion of the vane surface and the corresponding conformal portion of the slot surface diverge from each other by no more than 0.35% of the nozzle radius, and preferably no more than 0.3%, 0.2% or even 0.1% of the nozzle radius.

The conformal portion of the vane surface may extend along at least 20%, at least 30%, at least 40%, at least 60%, at least 80%, or at least 90% of the length of the median line.

In this document the statement that two lines diverge from each other by no more than a certain distance x may be understood to mean that the lines can be placed such that the lines do not cross and such that no point along either one of the lines is further than a distance x from the other of the lines. The statement that the conformal portion of the vane surface and the corresponding conformal portion of the slot surface diverge from each other by no more than a certain distance x refers to the parts of the conformal portion of the vane surface and the portion of the conformal portion of the slot surface which are in axial register with each other, and which appear as respective lines when viewed in the axial direction. In such a view, these lines diverge from each other by no more than the distance x.

Preferably, at room temperature, the conformal portion of the vane surface of the vane and the corresponding conformal portion of the slot surface can be positioned with a gap of no more than 0.35%, no more than 0.3%, no more than 0.2% or even no more than 0.1% of the nozzle radius (e.g. for a 48.1 mm nozzle radius, a gap of no more than 0.17 mm, no more than 0.1 mm, or even no more than 0.05 mm) between them along the whole of their respective lengths. Thus, leakage of gas between the vane inner surface and the slot inner surface can be reduced. If the conformal portion of the vane surface is shorter (e.g. at least 10% or 15% of the length of the median line, but not more than 30% or even no more than 20%) the divergence is preferably no more than 0.05% or even 0.02% of the nozzle radius (i.e. fora 48.1 mm nozzle radius, no more than 0.03 mm or no more than 0.001 mm). The divergence may, for example, be in the range 1 micron to 0.05 mm, or even 1 micron to 0.025 mm.

Note that this is in contrast to the known vane and slot arrangement discussed above, in which the vane and slot have the same general shape as viewed in the axial direction, but have different sizes at room temperature, so that each portion of the vane surface of has a different radius of curvature from the nearest portion of the slot surface.

In some embodiments, the conformal portion of the vane is positionable in contact with the corresponding portion of the edge of the slot along substantially the whole of the length of the conformal portion. For example, there may be more than two points of contact between them, and the maximum distance of any point of the conformal portion of the vane surface from the slot surface is no greater than 0.35%, 0.3% or even 0.2% of the nozzle radius. For example, in the case of a nozzle radius of 48.1 mm, the vane may be positionable such that the maximum distance of any point of the conformal portion of the vane surface from the slot surface is no greater than 0.17 mm, 0.15 mm or even 0.10 mm.

The conformal portion of the vane surface may include a portion of one of the convex end portions of the vane surface. If the conformal portion of the vane surface is on the inner face of the vane, this is typically a conformal portion at a leading edge of the vane. If the conformal surface is on the outer face of the vane, this is typically at a trailing edge of the vane. Preferably, the conformal portion of the vane surface includes at least the portion of the convex end portion of the vane surface between a first major vane surface and the median line.

BRIEF DESCRIPTION OF THE FIGURES

Embodiments of the disclosure will now be described for the sake of example only, with reference to the following drawings in which:

FIG. 10(*a*) is a perspective view of a portion of a second turbine housing which can be used in the embodiment of FIG. 8, FIGS. 10(*b*) and 10(*c*) are perspective views of a shroud for use with the turbine housing, and FIGS. 10(*d*) and 10(*e*) which show the second turbine housing in combination with the shroud respectively in a perspective view and in a cross-sectional view; FIG. 10(*e*) shows the installation of a variant of the pin element of FIG. 9, and FIG. 10(*f*) shows the pin element in use; and FIG. 10(*g*) shows a second variant of the pin element of FIG. 9.

DETAILED DESCRIPTION OF THE EMBODIMENTS

Figure 1A:
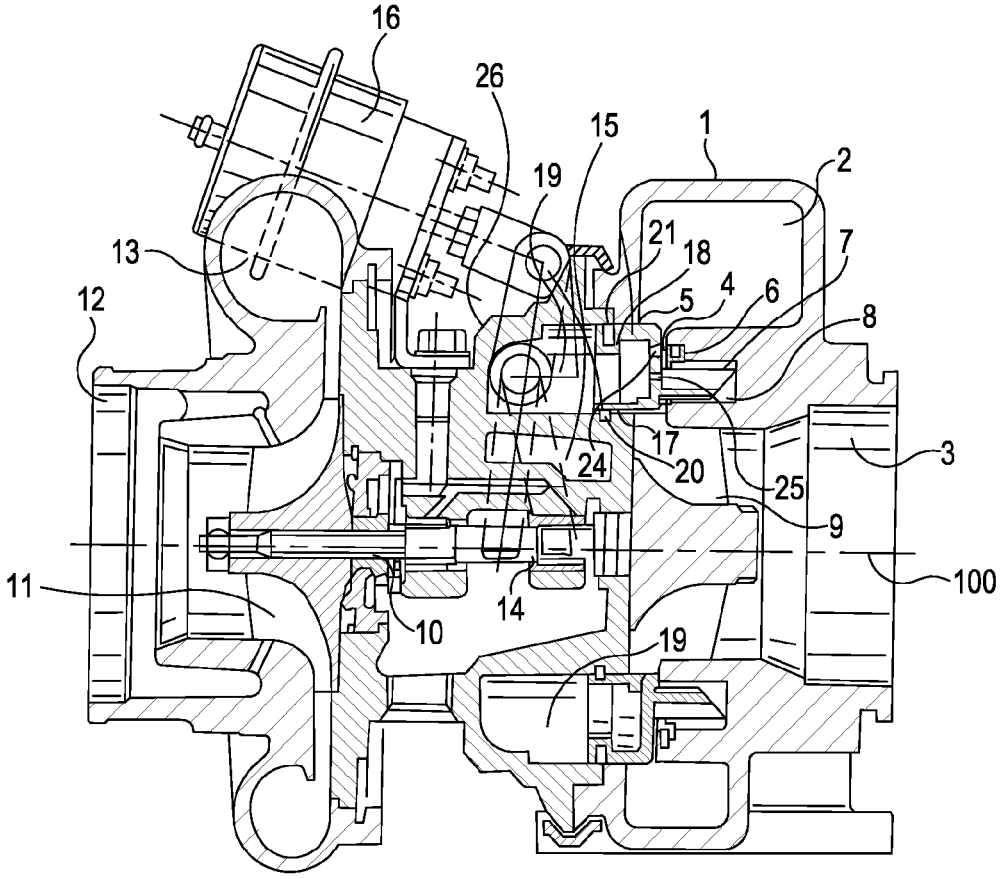
FIG. 1 is composed of FIG. 1(*a*) which is an axial cross-section of a known variable geometry turbine, and FIG. 1(*b*) which is a cross-section of a part of the turbine of FIG. 1(*a*)
Figure 1B:
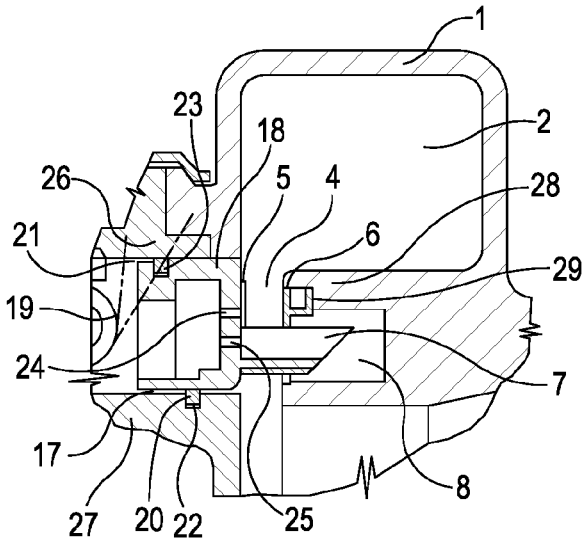
Figure 2:
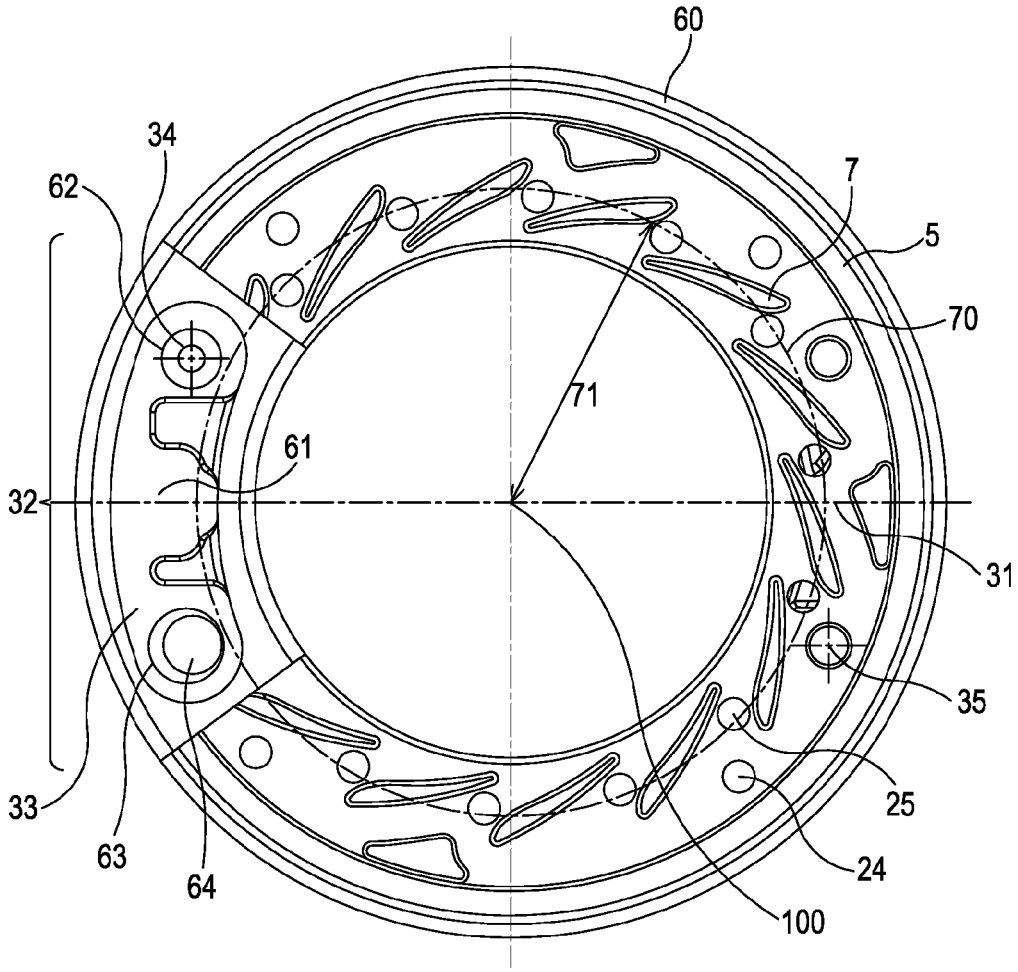
FIG. 2 is an axial view of a nozzle ring which can be used in the known arrangement of FIG. 1.

Referring to FIG. 2, a nozzle ring is shown which could be used in the known turbocharger of FIG. 1. The nozzle ring is viewed in an axial direction from the right as viewed in FIG. 1(*a*) (this direction is also referred to here as "from the turbine end" of the turbocharger), from a position between the nozzle ring 5 and the shroud 6.

The axis of the shaft about which the turbine wheel 9 (not shown in FIG. 2, but visible in FIG. 1(*a*)) and compressor wheel 11 (also not shown in FIG. 2, but visible in FIG. 1(*a*)) rotate is denoted as 100.

Viewed in this axial direction, the substantially-planar annular nozzle ring 5 encircles the axis 100. From the nozzle ring 5, vanes 7 project in the axial direction. Defining a circle 70 centred on the axis 100 and passing through the centroids of the profiles of the vanes 7, we can define the nozzle radius 71 as the radius of the circle 70.

Gas moves radially inwardly between the nozzle ring 5 and the shroud 6. In some turbines, the radially outer surface of the vanes 7 is a "high pressure" surface, while the radially inward surface of the vanes 7 is a "low pressure" surface. In other turbines, these roles are reversed.

The nozzle ring 5 is moved axially by an actuator 16 (not shown in FIG. 2, but visible in FIG. 1(*a*)) within an annular cavity (also not shown in FIG. 2, but visible in FIG. 1(*a*)) defined by a portion 60 of the turbine housing. Each vane 7 is optionally longitudinally-symmetric (that is, its profile as viewed in the axial direction, may be same in all axial positions), although in some embodiments only a portion of the vane 7 is longitudinally-symmetric.

The actuator exerts a force on the nozzle ring 5 via two axially-extending guide rods. In FIG. 2, a portion 32 of the nozzle ring 5 is omitted, making it possible to view the connection between the nozzle ring 5 and a first of the guide rods. The guide rod is not shown, but its centre is in a position labelled 61. The guide rod is integrally formed with a bracket 33 (commonly called a "foot") which extends circumferentially from the guide rod to either side. The bracket 33 contains two circular apertures 62, 63. The surface of the nozzle ring 5 which faces away from the shroud 6 is formed with two bosses 34, 64 which project from the nozzle ring 6. Each of the bosses 34, 64 has a circular profile (viewed in the axial direction). The bosses 34, 64 are inserted respectively in the apertures 62, 63, and the bosses 34, 64 are sized such that the boss 34 substantially fills the aperture 62, while the boss 64 is narrower than the aperture 63. The connection between the boss 34 and the aperture 62 fixes the circumferential position of the nozzle ring 5 with respect to the bracket 33 (in typical realizations, the relative circumferential motion of the nozzle ring 5 and the shroud 6 about the axis 100 is no more than 0.05 degrees). However, the clearance between the boss 64 and the aperture 63 permits the bracket 33 to rotate slightly about the boss 34 if the guide rods move apart radially due to thermal expansion. For that reason, the boss 34 is referred to as a "pivot".

The location, as viewed in the axial direction, at which a second of the guide rods is connected to the nozzle ring 5 is shown as 31. The connection between the nozzle ring 5 and the second guide rod is due to a second bracket (not visible in FIG. 2) integrally attached to the second guide rod. The second bracket is attached to the rear surface of the nozzle ring 5 in the same way as the bracket 33. The pivot for the second bracket is at the location 35.

Holes 24, 25 are balance holes provided in the nozzle rings for pressure equalisation. They are provided to achieve a desirable axial load (or force) on the nozzle rings.

Figure 3:
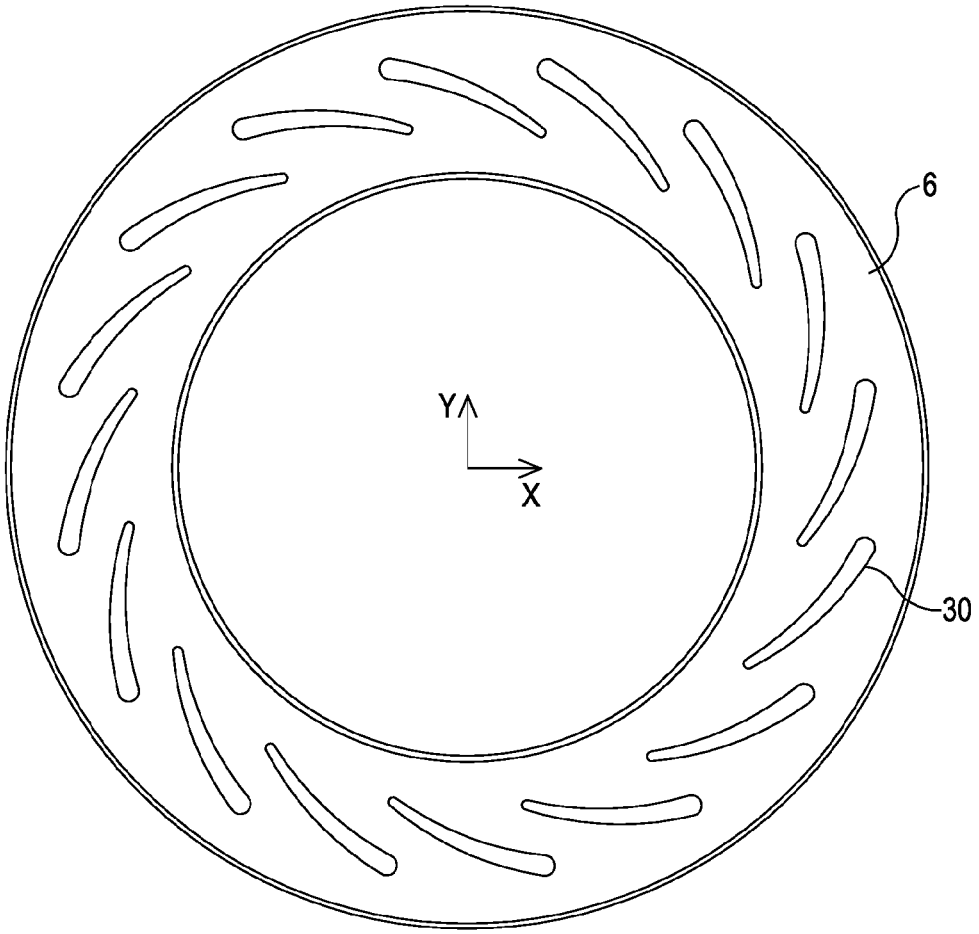
FIG. 3 is an axial view of a shroud which can be used in the known arrangement of FIG. 1.

Facing the nozzle ring 5, is the shroud 6 illustrated in FIG. 3. FIG. 3 is a view looking towards the shroud 6 from the nozzle ring 5 (i.e. towards the right side of FIG. 1). The shroud defines slots 30 (that is, through-holes) for receiving respective ones of the vanes 7. The edge of each slot is an inwardly-facing lateral (i.e. transverse to the axis 100) slot surface. Note that in FIG. 7 the slots 30 are not illustrated as having the same profile as the vanes 7 of FIG. 2, but typically the respective profiles do have substantially the same shape although the slots are of greater size than the vanes.

Figure 4:
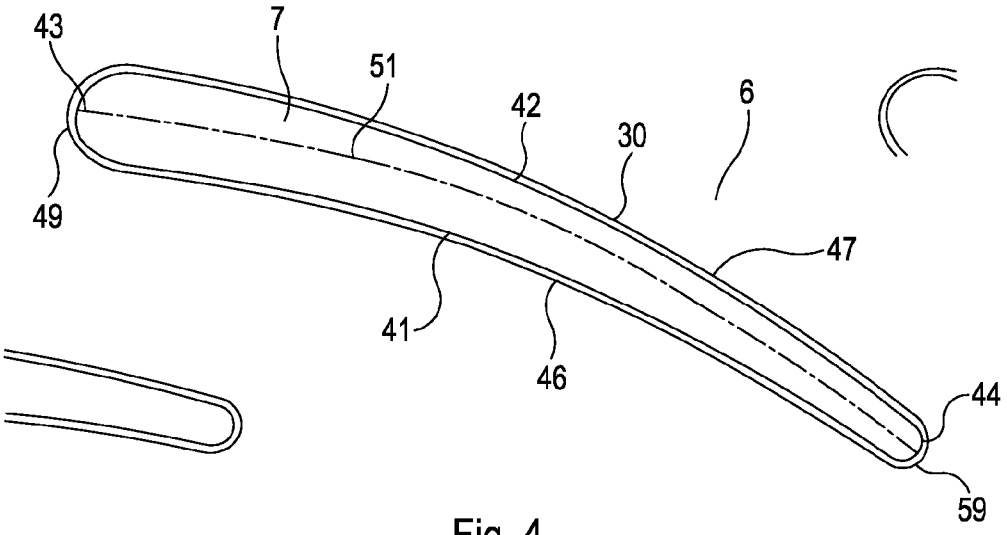
FIG. 4 shows the positional relationship between the nozzle ring of FIG. 2 and the shroud of FIG. 3.

FIG. 4 is another view looking in the axial direction from the nozzle ring 5 towards the shroud 6 (i.e. towards the right side of FIG. 1(*a*)), showing a representative vane 7 inserted into a respective representative slot 30. The vane 7 has a generally arcuate (crescent-shaped) profile, although in other forms the vanes are substantially planar.

Specifically, the vane 7 has a vane inner surface 41 which is closer to the wheel. The vane inner surface 41 is typically generally concave as viewed in the axial direction, but may alternatively be planar. The vane 7 also has a vane outer surface 42 which is closer to the exhaust gas inlet of the turbine. Each of the vane inner and outer surfaces 41, 42 is a major surface of the vane. The vane outer surface 42 is typically convex as viewed in the axial direction, but may also be planar. The major surfaces 41, 42 of the vane 7 face in generally opposite directions, and are connected by two axially-extending end surfaces 43, 44 which, as viewed in the axial direction, each have smaller radii of curvature than either of the surfaces 41, 42. The end surfaces 43, 44 are referred to respectively as the leading edge surface 43 and the trailing edge surface 44.

In most arrangements, the vane outer surface 42 is arranged to oppose the motion of the exhaust gas the inlet passage, i.e. the motion of the exhaust gas in the inlet passage is such as to direct the exhaust gas against the vane outer surface. Thus, the vane outer surface 42 is typically at a higher pressure than the vane inner surface 41, and is referred to as the "high pressure" (or simply "pressure") surface, while the vane inner surface 41 is referred to as the "low pressure" (or "suction") surface. These oppose corresponding portions of the inwardly-facing surface which define the edge of the slot 30, and which are given the same respective name.

In some possible arrangements, it is the vane inner surface 41 which redirects the flow of the gas. In this case, the vane inner surface 41 is typically at a higher pressure than the vane outer surface 42, and is referred to as the "high pressure" (or simply "pressure") surface, while the vane outer surface 42 is referred to as the "low pressure" (or "suction") surface. Again, they oppose corresponding portions of the inwardly-facing surface which define the edge of the slot 30, and which are given the same respective name.

As viewed in the axial direction, each vane 7 has a median line 51 which extends from one end of the vane to the other (half way between the vane inner and outer surfaces 41, 42 when viewed in the axial direction), and this median line has both a radial and a circumferential component. We refer to the surface of the slot which the vane inner surface 41 faces as the slot inner surface 46, and the surface of the slot which the vane outer surface 42 faces as the slot outer surface 47. As shown in FIG. 4, there is a gap of substantially constant width between the periphery of the vane 7 and the surface of the slot 30. This gap includes four portions: between the vane inner surface 41 and the slot inner surface 46; between the vane outer surface 42 and the slot outer surface 47; and between the vane's leading and trailing edge surfaces 43, 44, and respective leading and trailing portions 49, 59 of the edge of the slot. The surfaces 46, 47, 49 and 59 together constitute the inwardly-facing slot surface which defines the slot.

Figure 5:
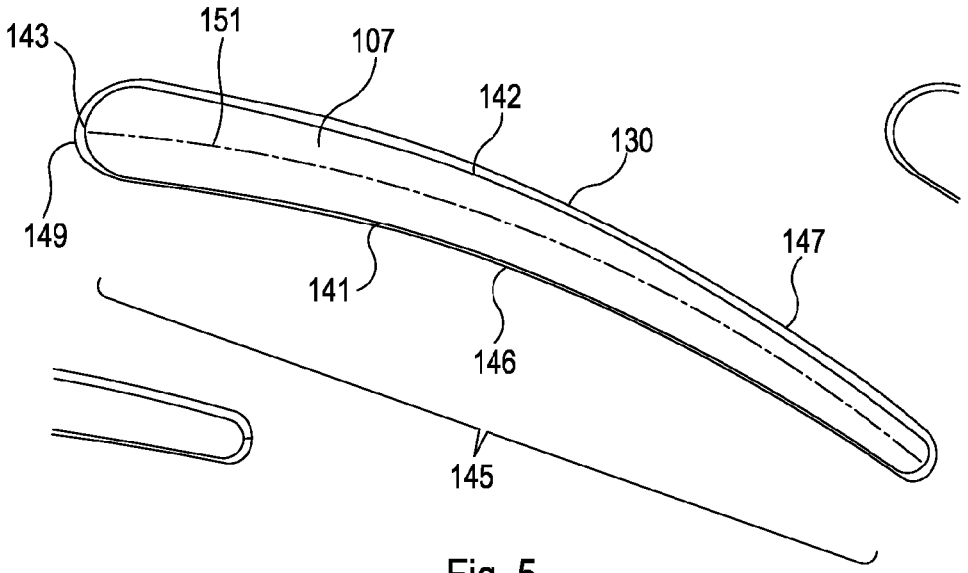
FIG. 5 shows a first possible positional relationship between the vanes and shroud in an embodiment of the disclosure.

Turning to FIG. 5, a first possible positional arrangement is shown between a vane and shroud slot in a turbine which is an embodiment of the disclosure. The turbine has the form illustrated in FIGS. 1 and 2, with the difference that the vanes and/or slots in the shroud are differently shaped and sized. In FIG. 5, elements corresponding to elements of FIG. 1 to 4 are given reference numerals 100 higher. Thus, a representative vane 107 is depicted within a representative slot 130. The vane outer surface 142 faces a slot outer surface 147, and a vane inner surface 141 faces a slot inner surface 146. Optionally, the vane 107 may be longitudinally-symmetric along the whole of its length (i.e. with the same profile, as viewed in the axial direction, in all axial positions). In another possibility, only a part of the vane 107 may be axially symmetric, e.g. including the portion which can be inserted into the slot 130 when the vane 107 is in its most advanced position. In this case, the portion of the vane shown in FIG. 5 is part of this axially symmetric portion of the vane. The vane 107 is integrally formed with the nozzle ring 5, as a one-piece unit, for example by casting and/or machining.

In contrast to the known vanes of FIG. 4, the vane 107 of FIG. 5 has a narrower clearance between the vane inner surface 141 and the opposed slot inner surface 146. By contrast, a much wider gap exists between the vane outer surface 142 and the corresponding portion 147 of the slot outer surface 147. This means that exhaust gas entering the shroud recess 8 between the outer vane surface 142 and the slot outer surface 147 is largely prevented from exiting the shroud recess between the vane inner surface 141 and the slot inner surface 146.

To encourage this effect, the vane surface and slot surface are formed with a conformal portion 145 which extends along at least about 15%, at least about 20%, at least about 30%, at least about 40%, at least about 50%, at least about 60%, or at least about 80% of the length of the median line 151, or even at least 85% or 90% of the length of the median line 151. As illustrated in FIG. 5, the conformal portion 145 of the vane surface in FIG. 5 includes substantially all of the vane inner surface 141. The profile (that is the shape, as viewed in the axial direction) of the vane inner surface 141 and a corresponding portion of the slot inner surface 146 are very similar to each other, so that they can be placed against each other with a very small (e.g. negligible) gap between them along the whole length of the conformal portion 145. Specifically, the profile of the vane inner surface 141 and the corresponding portion of the slot inner surface 146 at room temperature are such that they may be positioned against each other with a gap between them which, e.g. transverse to the median line 151, is no more than 0.35% of the nozzle radius 71, and preferably no more than 0.2% or 0.1% of the nozzle radius 71. On average over the conformal portion 145 of the vane surface, the gap between the vane inner surface 141 and the slot inner surface 146 is no more than 20%, or no more than 10% of the gap between the vane outer surface 142 and the slot outer surface 147. The vane's leading edge surface 143 is spaced from the corresponding portion of the inner surface of the slot 149.

Figure 6:
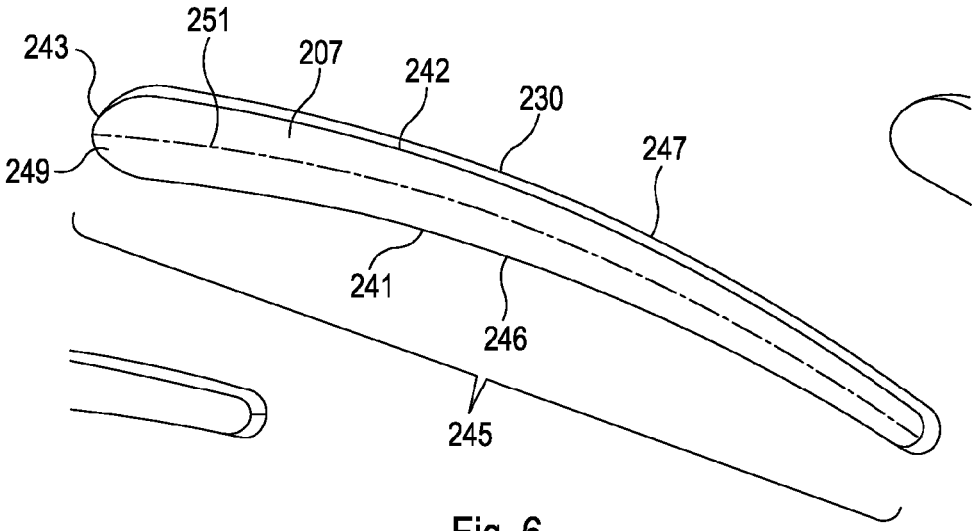
FIG. 6 shows a second possible positional relationship between the vanes and shroud in an embodiment of the disclosure.

Turning to FIG. 6, a second possible positional arrangement is shown between a vane 207 and shroud 230 slot in a turbine which is an embodiment of the disclosure. Elements having the same meaning as in FIG. 5 are given reference numerals 100 higher. The vane surface and slot surface are formed with a conformal portion 245 which extends along at least about 90% of the length of the median line 251. The conformal portion 245 of the vane surface in FIG. 6 includes substantially all of the vane inner surface 241 and also the majority of the vane leading end surface 243 which faces a leading edge surface 249 of the slot. At room temperature, the profile of the vane inner surface 241 and a corresponding portion of the slot inner surface 246 are substantially identical to within machining tolerances, so that they can be placed against each other with substantially no gap between them along the whole length of the conformal portion 245. There is a gap between the outer surface 242 of the vane 207 and the facing portion 247 of the slot 230.

Figure 7:
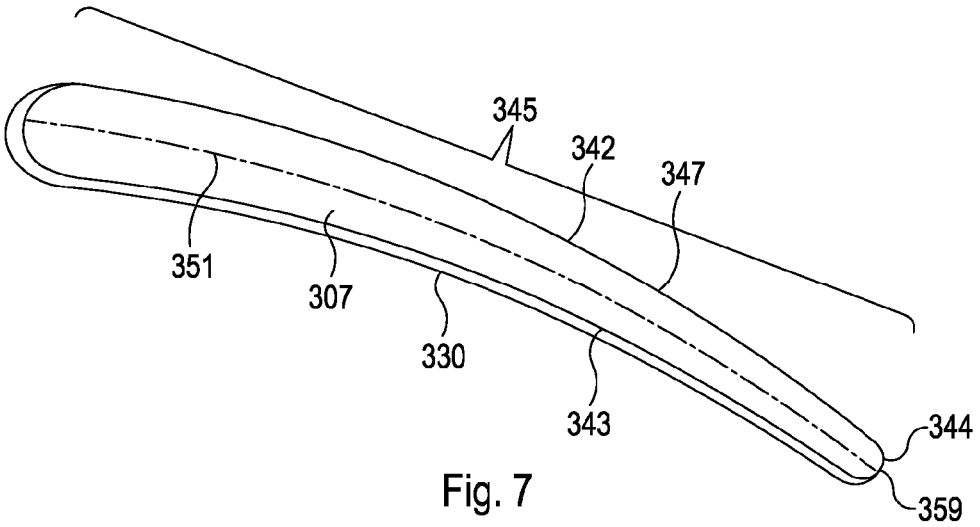
FIG. 7 shows a third possible positional relationship between the vanes and shroud in an embodiment of the disclosure.

Turning to FIG. 7, a third possible positional arrangement is shown between a vane 307 and shroud slot 330 in a turbine which is an embodiment of the disclosure. In this arrangement, the conformal portion 345 of the vane 307 is at the vane outer surface 342, and similarly the conformal portion 345 of the slot 330 is at the slot outer surface 347. The conformal portion 345 of the vane 307 includes most of the outer surface 342 of the vane 307, which lies against the slot outer surface 347 along at least 90% of the length of the median line 351. It further includes the trailing surface 344 which lies against the corresponding portion 359 of the slot edge up to a position which is radially inward of the intersection of the median line 351 with the trailing surface 344. This positional arrangement impedes gas flow from the outer surface 342 of the vane 307 to the inner surface 343 by substantially preventing gas leaking between the vane outer surface 342 and the slot outer surface 347.

In the positional relationships of FIGS. 5, 6 and 7, if there is differential thermal expansion between the vanes 107, 207, 307 and the shroud (for example, because they are formed from different materials and/or experience different temperatures), the conformal portion of the vane 107, 207, 307 may be forced against the slot inner surface 146, 246 or slot outer surface 347. Frictional force between them may then prevent axial motion of the vane relative to the shroud. However, even if, as in the system of FIG. 1, the nozzle ring and shroud were mounted in a "fixed" angular position, then there would be a certain free play in the system (for example, due to the coupling of the nozzle ring 5 to the rods illustrated in FIG. 2, the nozzle ring may have a certain inherent freedom to rotate about the axis 100), and experimentally we have found that this may be up to 0.05°. This would allow the vanes 107, 207, 307 to retract to a certain extent from the conformal portion of the surface of the slot. However, the extent of this retraction would be limited, and since it depends on the tolerances of the components it may be inconsistent from one turbine unit to another. Accordingly, in embodiments of the present disclosure (described below) the nozzle ring and the shroud are arranged to be relatively rotatable with respect to each other by a greater degree. The turbine is however arranged to generate a rotational force which urges the respective conformal portions of the surfaces of the nozzle ring and slot together.

Figure 8A:
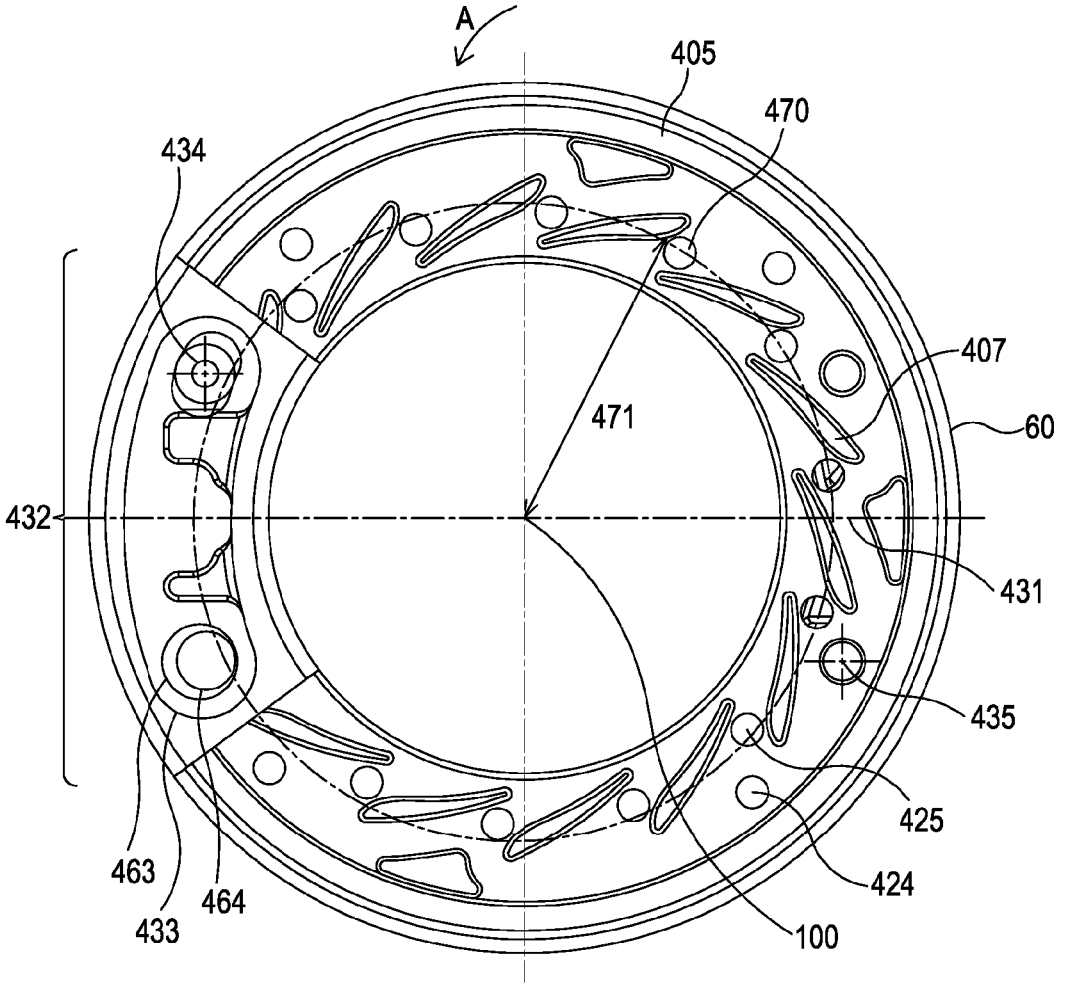
FIG. 8 is composed of FIG. 8(*a*), which is an axial view of a vane arrangement in a first embodiment of the disclosure, and FIG. 8(*b*) which is an expanded view of a portion of FIG. 8(*b*)
Figure 8B:
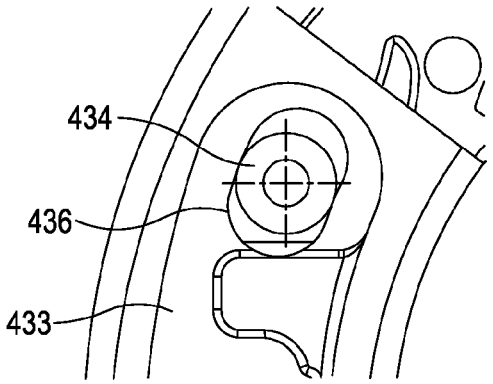
Figure 9A:
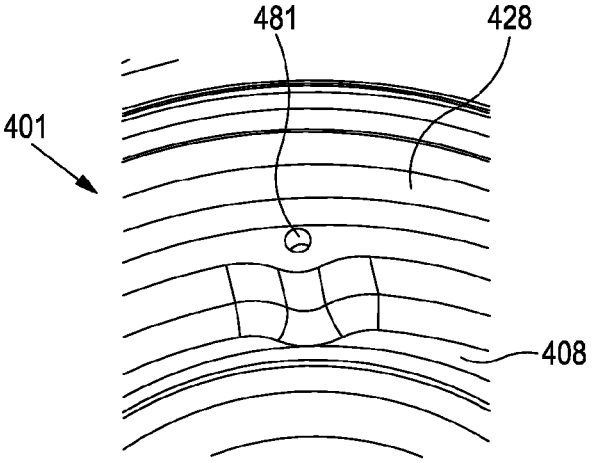
FIG. 9 is composed of FIG. 9(*a*), which is a perspective view of a portion of a first turbine housing which can be used with the embodiment of FIG. 8, FIG. 9(*b*) which shows a pin element for insertion into an aperture of the turbine housing of FIG. 9(*a*), and FIGS. 9(*c*)-9(*e*) which show the turbine housing in combination with a shroud respectively in a cross-sectional view, and cut-away view and an axial view.
Figure 9B:
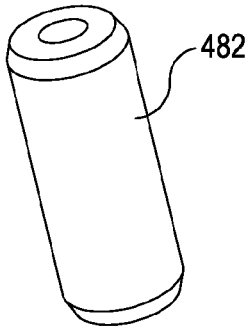
Figure 9C:
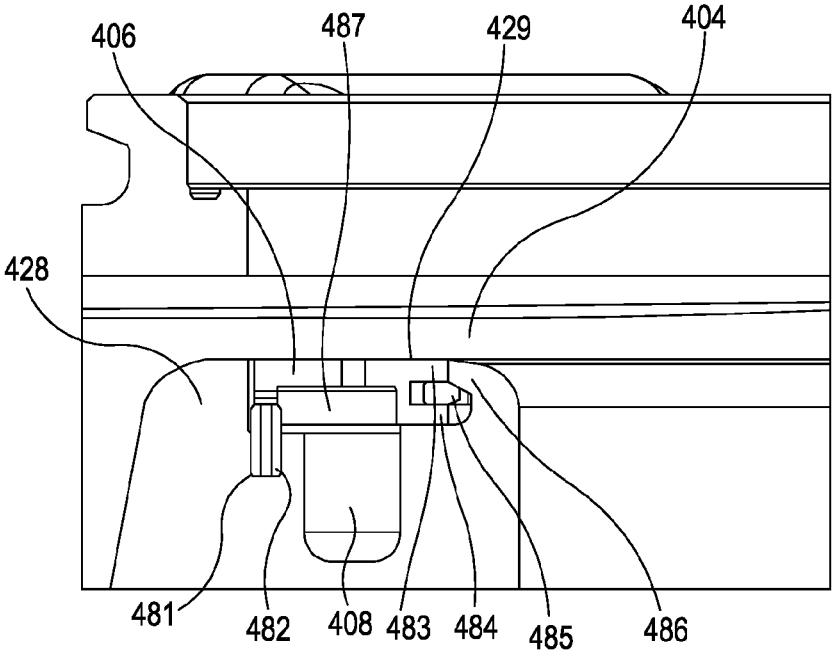
Figure 9D:
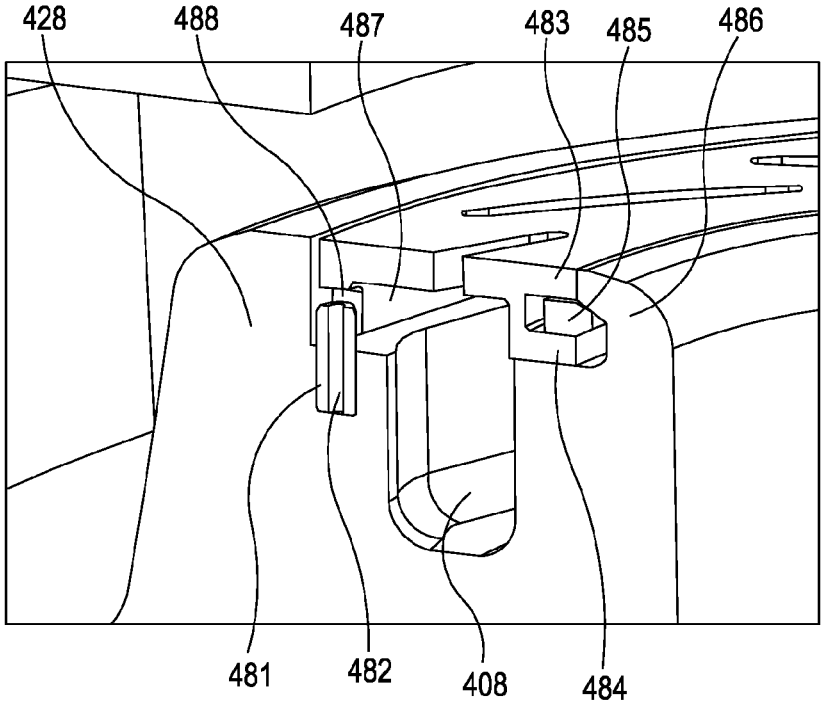
Figure 9E:
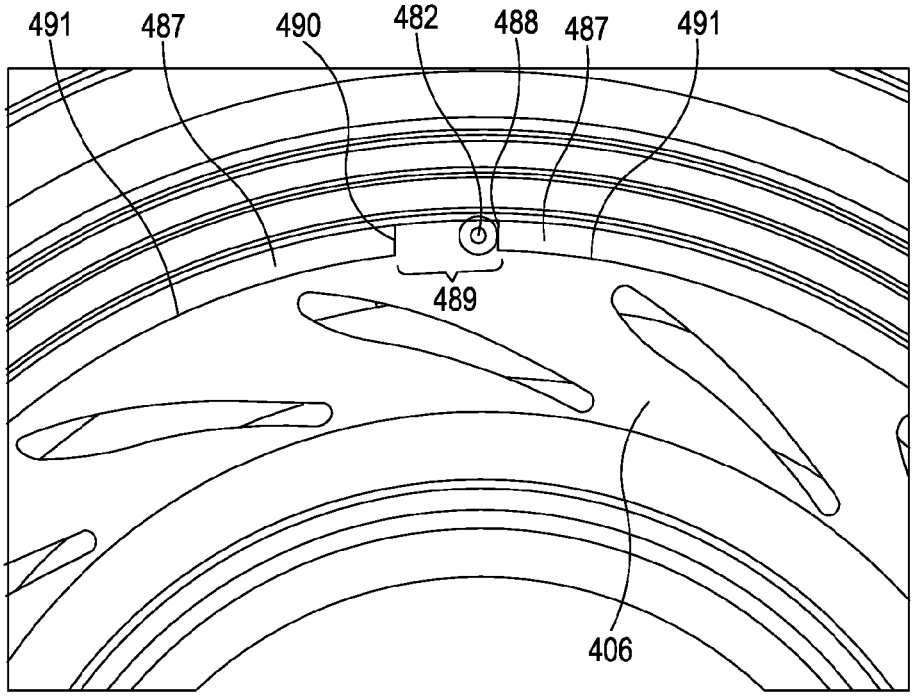
Figure 10A:
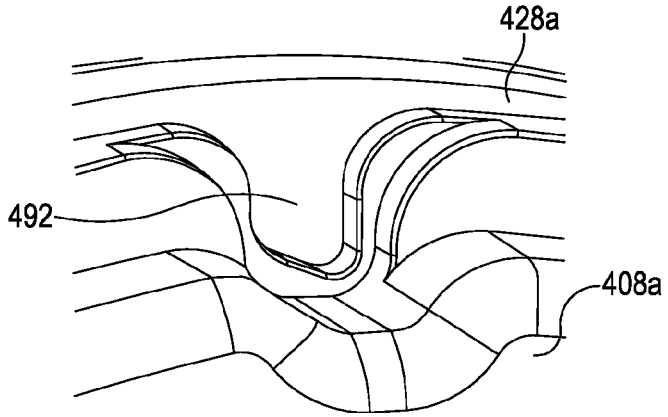
FIG. 10 shows three variants of the embodiment of FIG. 9.
Figure 10B:
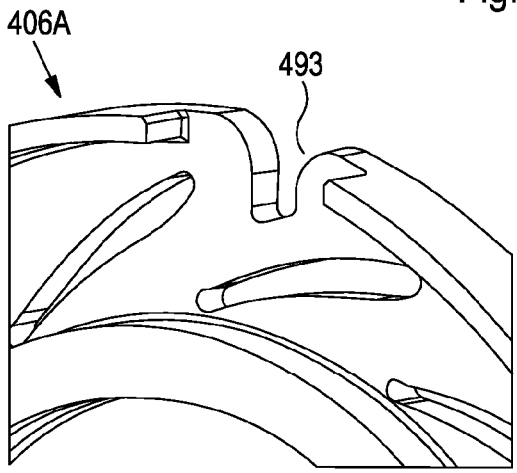
Figure 10C:
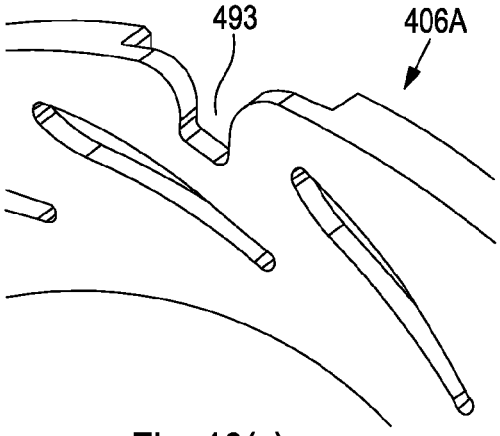
Figure 10D:
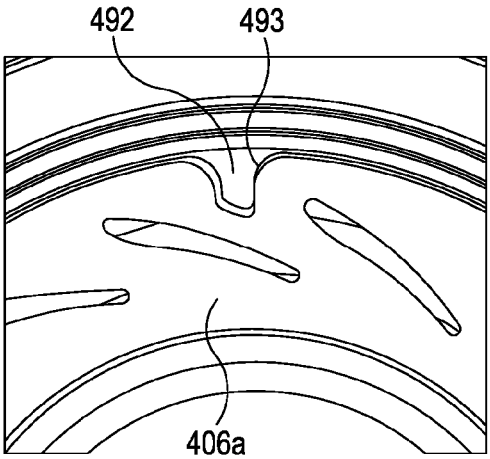
Figure 10E:
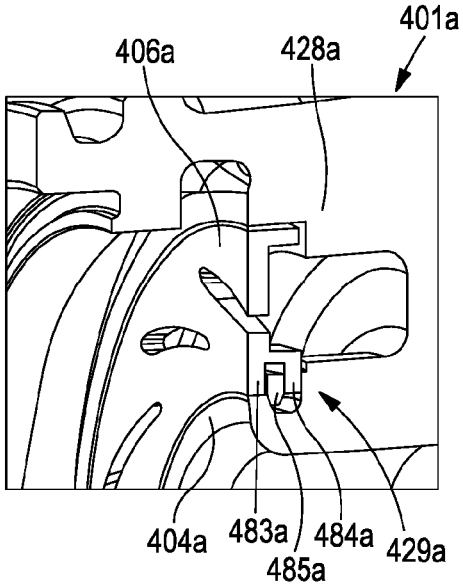
Figure 10F:
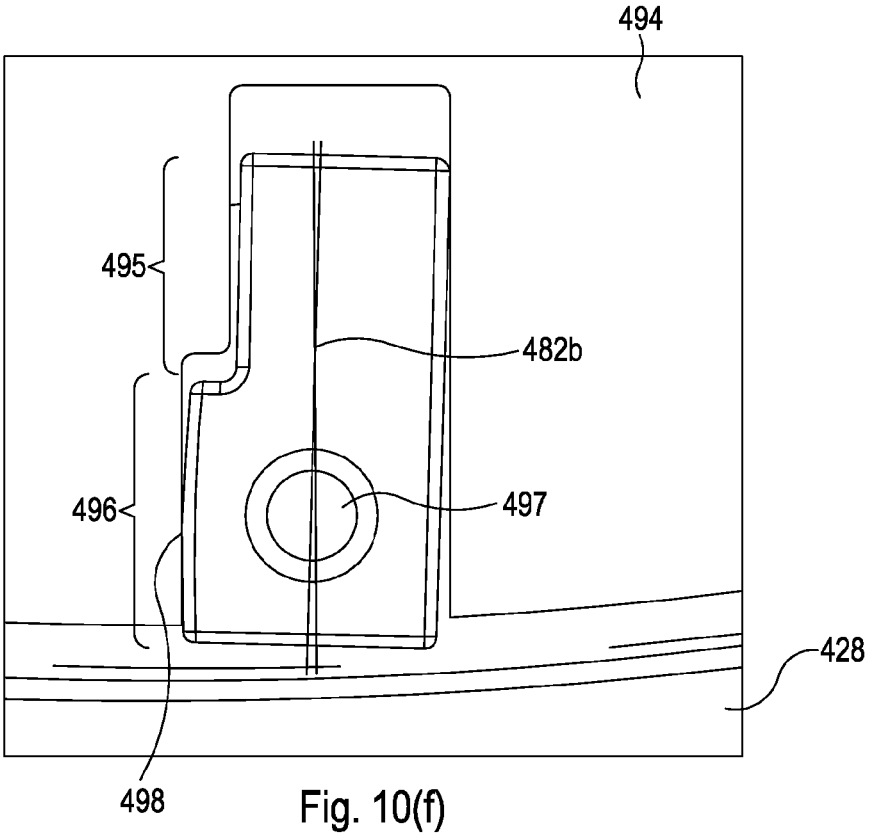
Figure 10G:
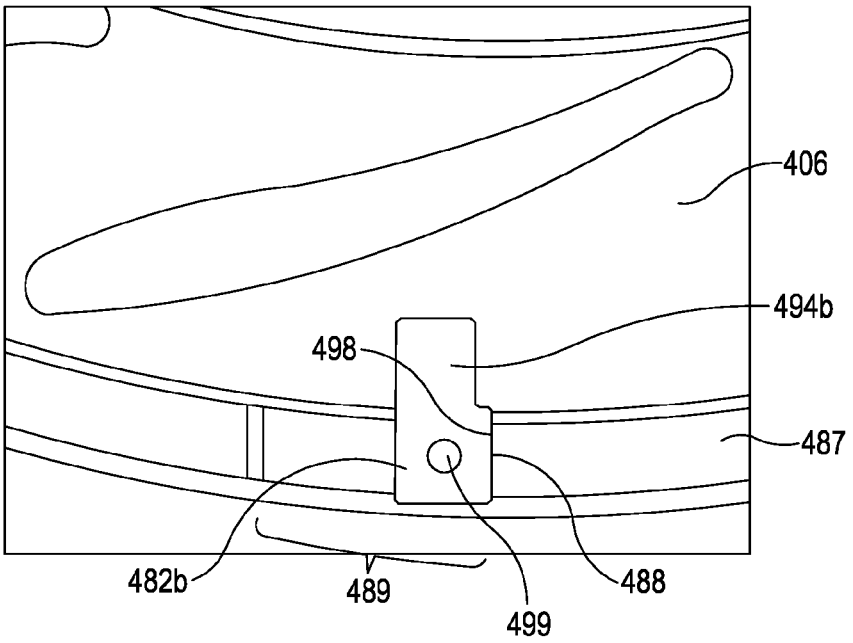
Figure 10H:
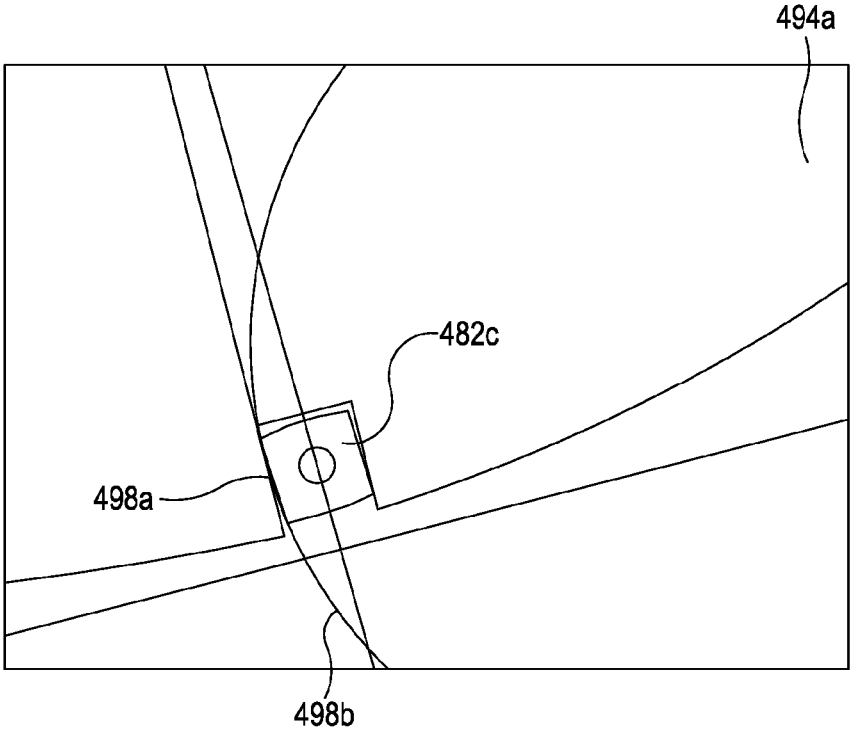

Specifically, FIG. 8 illustrates a nozzle ring in a first embodiment of the disclosure. Elements corresponding to elements of FIGS. 1 to 4 are given reference numerals 400 higher. The nozzle ring of FIG. 8 can again be used in a system such as the known one of FIG. 1, with the vane arrangement positioned within a chamber defined by a portion 60 of the turbine housing.

As in the nozzle ring of FIG. 2, the nozzle ring 405 of the embodiment of FIG. 8 includes a plurality of equally circumferentially-spaced, axially-extending vanes 407 for insertion into slots of a shroud 6 having the same appearance as the known shroud 6 of FIG. 3. The vanes 407 and slots may have the profiles and positional arrangement illustrated in any of FIG. 5 or FIG. 6, such that a conformal portion of the surface of one of the vanes 407 may be placed against a corresponding conformal portion of the edge of the corresponding slot, or with a small clearance between them. The centroids of the vanes 407 lie on a circle 470 which has a radius 471, which is the nozzle radius.

Like FIG. 2(*a*), FIG. 8(*a*) shows how the vane arrangement would appear as viewed in the axial direction from a position between the nozzle ring 405 and shroud 6. As for the known arrangement of FIG. 2, the nozzle ring 405 is movable in either axial direction within an annular cavity (not shown, but of the same construction as shown in FIG. 1) defined by a portion 60 of the turbocharger housing by an actuator (not shown, but of the same construction as shown in FIG. 1), by means of two axially-extending guide rods which the actuator can move in either axial direction. Holes 424, 425 in the nozzle ring 405 are balance holes provided in the nozzle ring 405 for pressure equalisation. They are provided to achieve a desirable axial load (or force) on the nozzle. In use, within an arrangement such as that of FIG. 1, exhaust gas moves radially inwardly towards the turbine wheel in the direction A. Thus, the radially outer surfaces of the vanes 407 are high pressure surface, and their radially inner surfaces are low pressure surfaces. Thus, the exhaust gas exert a force on the outer surface of the vanes 407 which urges the vanes to move in the clockwise direction of FIG. 8(*a*).

The connection between the nozzle ring 405 and a first of the guide rods is illustrated in FIG. 8(*a*) by neglecting a portion 432 of the front of the nozzle ring 405, to reveal a bracket 433 ("foot") which is fixedly mounted to the first of the guide rods. The surface of the nozzle ring 405 which faces away from the shroud 6 is formed with two bosses 434, 464 which project from the nozzle ring 405 in the axial direction away from the turbine wheel. Each of the bosses 434, 464 has a circular profile (viewed in the axial direction). The bracket 433 includes a circular aperture 463 into which the boss 464 is inserted. The aperture 463 has a larger radius than the boss 464, thus permitting the bracket 33 to rotate slightly about the boss 34 if the guide rods move apart radially due to thermal expansion. For that reason, the boss 34 is referred to as a "pivot".

FIG. 8(*b*) is an enlarged portion of FIG. 8(*a*), showing that the bracket 433 includes an arcuate slot 436, instead of the circular aperture 62 of the known system of FIG. 2. The arcuate slot 436 has a curved central axis extending in the circumferential direction about the axis 100. The boss 434 is inserted into the arcuate slot 436. Transverse to the central axis, the width of the arcuate slot 436 is only slightly larger than the diameter of the boss 434, so the edge of the slot provides a control surface to guide the boss along a path. The connection between the boss 434 and the aperture 436 fixes the radial position of the boss 434, but permits relative circumferential motion of the nozzle ring 405 with respect to the bracket 433. The amount of this circumferential movement is limited by the length of the arcuate slot. In typical realizations, the relative circumferential motion of the nozzle ring 405 and the shroud 6 about the axis 100 is by at least 0.1 degrees, and may be at least 1 degree, at least 1.5 degrees, and up to about two degrees. Note that in a variation, instead of an arcuate slot 436, the bracket 433 may include an (e.g. circular) aperture within which the boss 434 moves, so that the combination of the boss and aperture permits relative circumferential motion of the nozzle ring 405 and the shroud 6 by at least 0.1 degrees. The boss 434 remains within a region defined by the aperture, but the edge of aperture does not limit the position of the boss 434 to be a location on a path defined by the aperture.

The connection between the nozzle ring 405 and the second guide rod is due to a second bracket (not visible in FIG. 8) integrally attached to the second guide rod, and having the same shape as the bracket 433. The location, as viewed in the axial direction, of the second guide rod is shown as 431. The second bracket is attached to the rear surface of the nozzle ring 5 in the same way as the bracket 433. The position of the boss for the second bracket which corresponds to the boss 434 of the bracket 433, is indicated as 435; this boss lies within a circumferentially-extending arcuate slot of the second bracket, so that the boss and slot cannot move relatively in the radial direction, but can move relatively in the circumferential direction. The length of the arcuate slot may the same as that of the arcuate slot 436.

Thus, the brackets 433 and bosses 434 together form a coupling mechanism which permits the shroud 6 and nozzle ring 405 to move relatively in the circumferential direction. However, the centres of the nozzle ring 405 and shroud 6 remain on the axis 100, and the overall plane of each of the nozzle ring 405 and shroud 6 remains substantially transverse to the axis 100.

Due to the force applied by the exhaust gas in the circumferential direction to the vanes 407, the vanes 407 are urged in this direction. This motion is permitted by the connection between the brackets 433 and the respective bosses 434, so that the inner surface of each vane 407 is pressed against the corresponding slot inner surface. Relative circumferential motion of the nozzle ring 405 and the shroud is referred to as "clocking". This motion is possible because the bosses 434 slide within the slots 436 of the brackets 434, so that the nozzle ring 405 can move circumferentially even though the guide rods do not. The shroud in this case is mounted so as not to be moveable relative to the turbine housing.

Since, as explained above with reference to FIGS. 5 and 6, a conformal portion of the inner surface of vane 407 has substantially the same profile (i.e. the same shape and same dimensions) as a corresponding conformal portion of the inner edge of the respective slot, the vane 407 and the slot edge lie very close together, or even substantially in contact, along the whole of the conformal portion of the vane 407. In particular, the conformal portion of the vane 407 may include the entire vane inner surface which exactly coincides with a corresponding portion of the slot inner surface.

Thus, the embodiment benefits from the force of the exhaust gas to ensure that the conformal portion of the vane surface is pressed against the corresponding conformal portion of the edge of the slot, with little or no clearance between them. This reduces, or even eliminates leakage of gas between the conformal portion of the vane surface and the corresponding conformal portion of the edge of the slot out of the recess 8.

If the vane 407 thermally expands, the vane can expand into the clearance at the outer surface of the vane 407. This causes the nozzle ring 405 to move circumferentially (in the anti-clockwise direction in FIG. 8(*a*)) relative to the shroud 6, and relative to the actuator 16 and the guide rods. This motion is opposed by the pressure of gas on the outer surfaces of the vanes 407, which urges the respective conformal portions of the surfaces of the vane and slot together. Thus, despite the differential thermal expansion of the nozzle ring and shroud, a close connection between the conformal portion of the vane 407 and the edge of the respective slot is maintained, without an excessive force being developed between them.

As discussed above, the first embodiment shown in FIG. 8 can be employed in a known turbocharger as illustrated in FIG. 1. However, FIGS. 9 and 10 illustrate portions of two respective novel turbines (such as turbines of turbochargers or other turbo-machines) in which the nozzle mechanism of FIG. 8 can also be advantageously employed.

Specifically, FIG. 9(*a*) shows a turbine housing 401 having a portion 428 for defining a recess 408 and for retaining a ring-shaped shroud 406 covering the recess 408. The portion 428 of the turbine housing 401 defines, on its surface facing towards the bearing housing, an aperture 481. The aperture 481 is the opening of a circular-cylindrical cavity having a rotational axis extending approximately in the axial direction (i.e. parallel to the rotational axis). FIG. 9(*b*) shows a circular-cylindrical pin element 482 which can be inserted into the aperture 481, e.g. so as to substantially fill it, with a rotational axis of the pin element 482 extending in the axial direction. The pin element 482 may be longer than the depth of the aperture 481, and extends out of the aperture 481.

FIG. 9(*c*) is a cross-sectional view of the turbine housing 401 when it is supporting the shroud 406, whereas FIG. 9(*d*) is a cut-away perspective view of the turbine housing 401 and the shroud 406. In both views the bearing housing and the nozzle ring are omitted. The radially-inner portion of the shroud 406 defines a bracket 429, having inner and outer annular walls 483, 484. Between the annular walls 483, 484 is positioned a retaining ring 485. The retaining ring 485 extends radially-inwardly out of the gap between the annular walls 483, 484, and its inner portion is retained by an annular lip 486 of the portion 428 of the turbine housing. Providing the retaining ring 485 at the radially inner portion of the shroud 406, has been found to provide excellent resistance to gas leakage at the radially-inner edge of the shroud 406 from the recess 408 into the inlet passage 404.

In a radially-outer portion of the shroud 406 is provided a wall 487 extending in the axial direction away from the inlet passage 404.

FIG. 9(*e*) is a plan view of the shroud 406 looking axially from the direction of the bearing housing. The wall 487 is on the reverse of the shroud 406 so it is not visible in FIG. 9(*e*) but its outline is indicated by the line 491. Similarly, FIG. 9(*e*) marks the position of the pin element 482, although it too is on the rear of the shroud 406. The wall 487 extends around the majority of angular positions about the axis of the turbine, but the wall 487 includes a gap 489 between circumferentially-facing surfaces 488, 490 of the wall 487. When the shroud 406 is supported by the portion 428 of the turbine housing 401, the pin element 482 is within the gap 489 in the wall 487. Thus, the pin element 482 firmly prevents the shroud 406 from rotating in the anti-clockwise direction as viewed in FIG. 9(*a*). Note that this achieved without requiring high tolerance in the shape of the shroud 406. This is becuase the exact extent of the gap 489 is not relevant. Provided it is significantly larger than the diameter of the pin element 482 (e.g. at least 50% larger), the pin element 482 can be inserted into it when the shroud 406 is attached to the portion 428 of the turbine housing 1. Only the surface 488 of the shroud 406 impacts on the pin element 482.

FIG. 10 shows three variants within the scope of the claims of the embodiment of FIG. 9, respectively in FIGS. 10(*a*)-(*e*), FIGS. 10(*f*)-(*g*) and FIG. 10(*h*). Turning firstly to FIGS. 10(*a*)-(*e*), elements having the same meaning as those in FIG. 9 are given a reference numeral which is the same but followed by the letter "a". As shown in FIG. 10(*a*), in this form of the turbine housing 401*a*, the portion 428*a* of the turbine housing 401*a* is formed with a shoulder 492 (instead of with an aperture). The shoulder 492 may be radially outward from the recess 408*a*.

As shown in the perspective views of FIGS. 10(*b*) and 10(*c*), the shroud 406*a* is formed with a recess 493 at its radially-outer edge for receiving the shoulder 492. Thus, the shroud 406 is prevented from rotation about the rotational axis of the turbine. FIG. 10(*d*), which is a perspective view of the shroud 406*a* mounted on the portion 428*a* of the turbine housing 401, shows the shoulder 492 inserted into the recess 493. Thus, in use, the shoulder 493 prevents rotation of the shroud 406 around the axis of the turbine. Thus, the shoulder 493, like the pin element 482 of the arrangement of FIG. 9, acts as a limit element of the turbine which bears against a circumferentially-facing surface of the shroud (the surface defining the recess 493) and limits rotation of the shroud 406*a* about the axis.

As in the arrangement of FIG. 9, the shroud 406*a* is provided with an annular retaining ring 485*a* at its radially inner side. The retaining ring 485*a* may be inserted between two walls 483*a*, 484*a* of a bracket 429*a* defined by the radially-inner portion of the shroud 406*a*. The radially-inner retaining ring 485*a* is effective at preventing gas leakage from the recess 408*a* into the inner passage 404*a*.

Turning to FIGS. 10(*f*)-(*g*), a further variant is shown. The cyclindrical pin element 482 of FIG. 9 is replaced by a pin element 482*b* shown in FIG. 10(*f*), which is composed of two portions 495, 496. These are each illustrated as substantially cuboidal. The portion 496, which is illustrated as larger than the portion 495, defines an aperture 497 which may be a substantially circular-cylindrical through hole. The portion 496 has a rounded 498, e.g. a non-circular cylindrical surface, discussed below.

FIG. 10(*g*) shows the pin element 482*b* in use with a shroud 406 which is substantially the same as in FIG. 9, and so is designated by the same reference numeral. Whereas the pin element 482 of FIG. 9(*b*) in use extends axially out of the aperture 481, in the arrangement of FIG. 10(*g*) the longest dimension of the pin element 482*b* extends radially. That is, the portion 495 is a radially-inner portion, and the portion 496 is a radially-outer portion. The radially-outer portion 496 has a greater circumferential width than the inner portion 495. The radially-inner portion 495 is circumferentially recessed relative to the surface 498 of the radially-outer portion 496. A second pin 499 (shown looking along its length axis in FIG. 10(*g*)) passes through the aperture 497, and extends in the axial direction of the turbine into an aperture in the turbine housing which may be the aperture 481 of FIG. 9. This secures the pin element 482*b* to the turbine housing.

In FIG. 10(*g*) the shroud 406 is viewed from the rear (i.e. looking towards the nozzle ring). The radially-outer portion 496 is located within the gap 489, with the face 498 facing the surface 488 of the wall 487, which extends axially from the shroud 406. Thus, both surfaces 488 and 498 face circumferentially. Rotational motion of the shroud 406, in the clockwise direction as seen in FIG. 10(*g*), is limited by the surface 488 of the pin element 482*b*.

The surface 498 is substantially flat, thus reducing the contact pressure compared to the round pin element 482. However, it is preferably not exactly flat, but instead may be convex and slightly curved, e.g. with a radius of curvature much greater (e.g. 3 times greater) than the circumferential extent of the pin element 482*b*. Thus, the contact between the surface 498 and the surface 488 is not at a corner of either element, but between the rounded surface 498 and the flat surface 488. In a variation, the surface 488 also might be rounded, or be the only rounded surface. Note that the radially-inner portion 495 of the pin element 482*b*, which is radially inward of the wall 487, may lie against the rear surface of the shroud 406 or be axially separated from it. Its circumferentially-facing surfaces do not limit the motion of the shroud. However, the inner portion 495 can increase the strength of the pin element 482*b*.

FIG. 10(*g*) illustrates the installation of the pin element 482*b* in the assembly process of the turbine. The pin element 482*b* is held in correspondingly-shaped gap in an assembly tool 494, and moved by moving the assembly tool 494 to an appropriate position relative to the portion 428 of the turbine housing. Then the pin 499 can be threaded through the through-hole 497, to secure the pin element 482*b* to the tubine housing.

A further variation is shown in FIG. 10(*h*). This variation includes a pin element 482*c* which is is equivalent to the pin element 482*b* of FIG. 10(*f*), but omits the inner portion 495. One circumferentially-facing surface 498*a* of the pin element 482*c* is for implacting, and limiting the motion of, the surface 488 of the shroud 406 of FIG. 9. The pin element 482*c* has the same cross-section (shape and size) in all planes parallel to the page.

Thus, the surface 498*a* includes straight lines extending into the page, but the intersection of these lines with the page is a curved line 498*b*. In other words, the surface 498*a* is substantially flat, but more exactly is a convex (non-circular) cylindrical surface with a radius of curvature much greater (e.g. 3 times greater) than the circumferential extent of the pin element 482*c*. In FIG. 10(*h*) the pin element 482*c* is shown during the assembly process of the turbine, being supported in an appropriately sized gap within an assembly tool 494*a*.

Figure 11A:
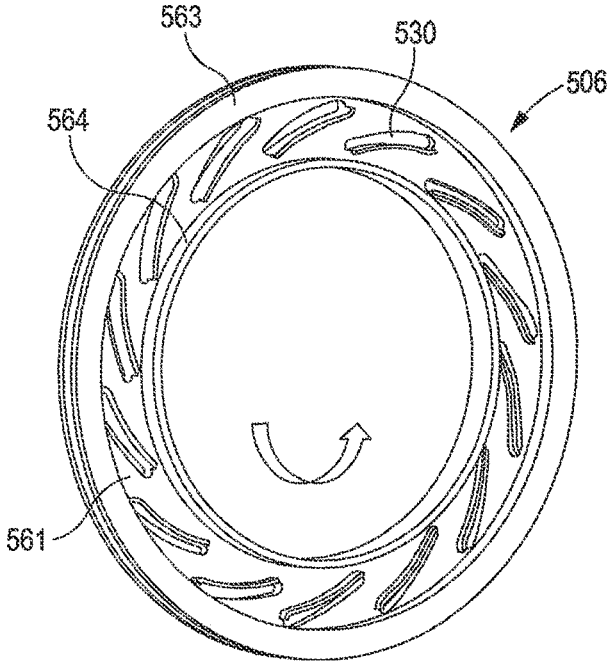
FIG. 11, which is composed of FIGS. 11(*a*) and 11(*b*), illustrates a shroud in a second embodiment of the disclosure.
Figure 11B:
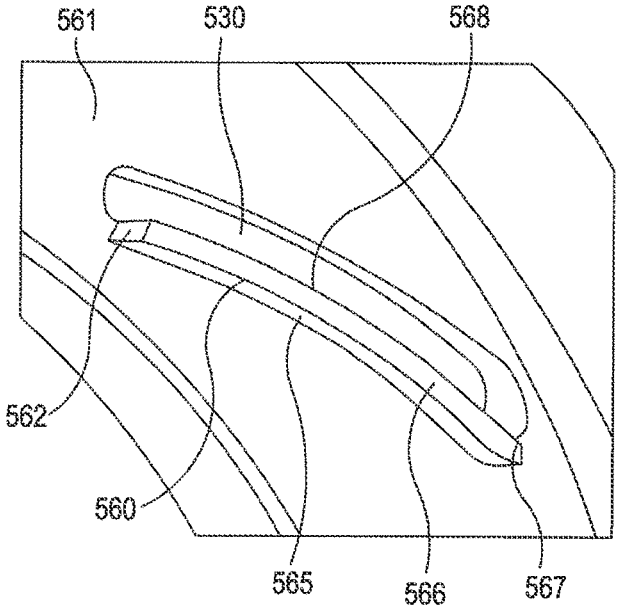
Figure 12A:
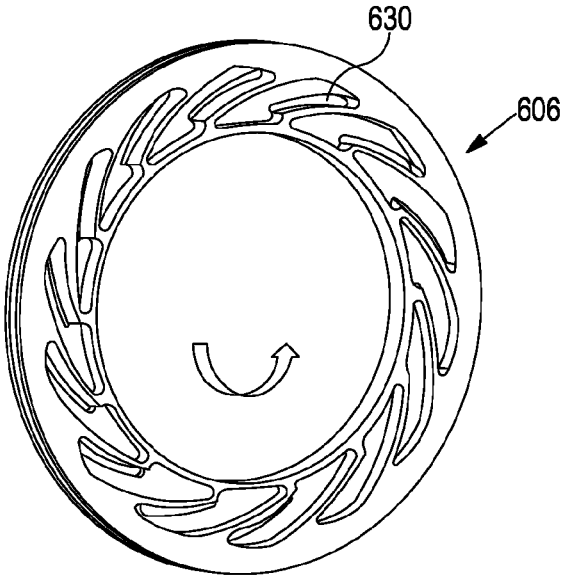
FIG. 12, which is composed of FIGS. 12(*a*) to 12(*c*), illustrates a shroud in a third embodiment of the disclosure.
Figure 12B:
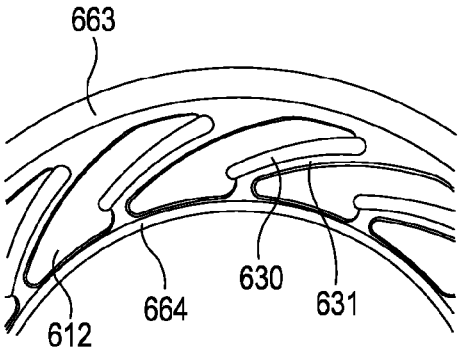
Figure 12C:
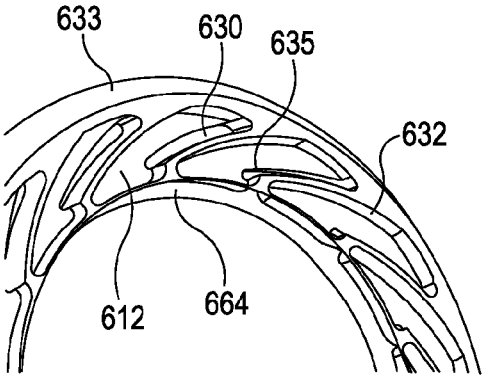
Figure 12D:
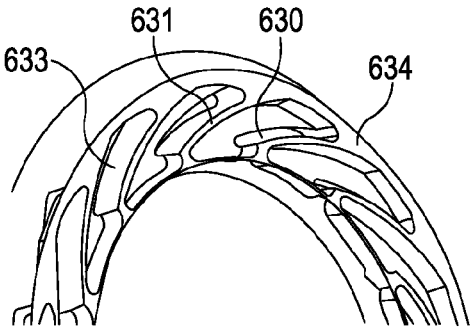
Figure 13A:
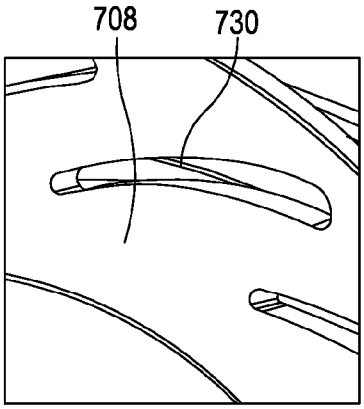
FIG. 13, which is composed of FIGS. 13(*a*) to 13(*f*), illustrates a portion of a shroud in fourth to ninth embodiments of the disclosure.
Figure 13B:
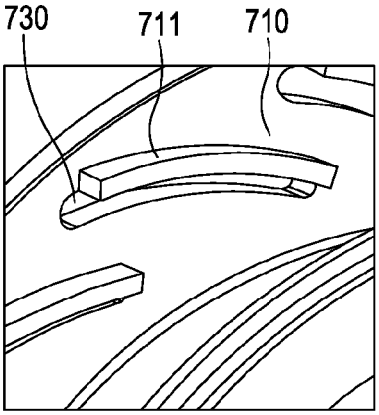
Figure 13C:
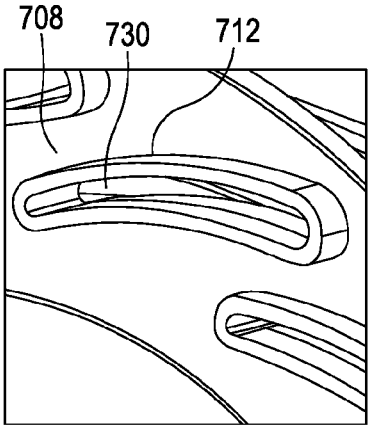
Figure 13D:
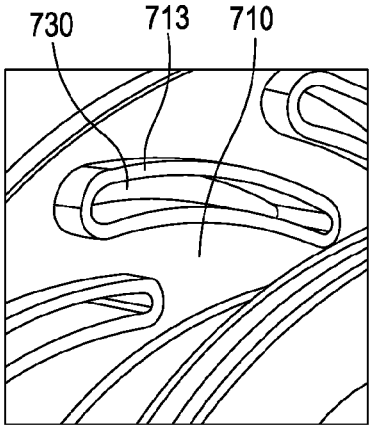
Figure 13E:
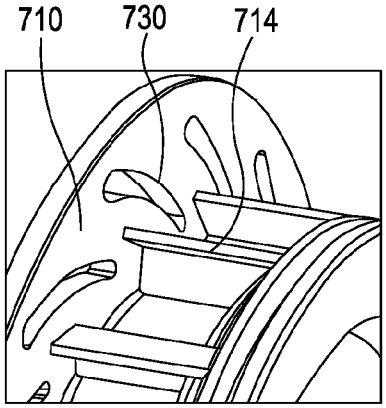
Figure 13F:
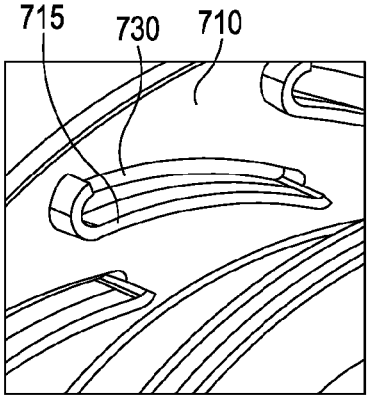

Turning to FIG. 11(*a*), a shroud 506 is shown of a second embodiment of the disclosure. This second embodiment is again a turbocharger with the general form of FIG. 1, and elements of the embodiment other than the shroud 506, and its coupling to the turbine housing, are identical to the known turbocharger of FIG. 1, and therefore will be referred here by the same respective reference numerals. In particular, the nozzle ring 5 of the turbocharger may be as shown in FIG. 2, and is arranged for axial motion under the control of an actuator 16 as illustrated in FIG. 1. Like the shroud 6 of the known turbocharger of FIG. 1, the shroud 506 of the second embodiment is mounted in the turbine housing 1 in such a way that it is maintained at a fixed axial position (the same position illustrated in FIG. 1), and with its overall plane held perpendicular to the rotational axis 100. However, in contrast to the known arrangement of FIG. 1, the coupling between the shroud 506 and the turbine housing 1 permits the shroud 506 to rotate freely about the rotation axis 100 of the turbine wheel. Its rotation is limited only by interaction with the vanes of the nozzle ring.

The shroud 506 is viewed in FIG. 11(*a*) in a perspective view, looking at its face which, in use, is away from the nozzle ring 5. The shroud 506 is formed with a land surface 561 which is planar and transverse to the axis 100. The land surface 561 is formed with plurality of slots 530 which are through-holes. The land surface 561 extends between an outer rim 563 and an inner rim 564. Each of the slots 530 is defined by (i.e. has an edge which is) an inwardly-facing surface which at all points contains the axial direction. In other words, the slot 530 has longitudinal symmetry in the axial direction.

The outer rim 563 is typically where the shroud 506 is coupled to the turbine housing 1. The outer rim 563 may, for example, be trapped in a toroidal space defined between a circular surface of the turbine housing 1 and a toroidal plate (not shown) mounted to the turbine housing 1, such that the outer rim 565 is able to rotate in the toroidal space about the rotational axis 100.

FIG. 11(*b*) is an enlarged view of a portion of FIG. 11(*a*), and shows that each slot 530 is provided with a respective ridge element 560 which is upstanding from the land surface 561 in the axial direction away from the nozzle ring 5. The ridge element 560 extends along a portion of the edge of the slot 530. The ridge element 560 is elongate and curved. It extends between a trailing (radially inner) end 562 and a leading (radially outer) end 567. Looking along an extension direction of the ridge element 560 (i.e. in the direction from inner end 562 towards outer end 567), the ridge element 560 has a rectangular form. It is defined between two wall surfaces 568, 565, which each extend in the axial direction 100, and a top surface 566 which is transverse to the axial direction 100. The wall surface 568 is on the side of the ridge element 560 facing towards the slot 530. Each part of the wall surface 568 which is towards the slot 530 is flush with the closest portion of the radially inner surface of the slot 530, i.e. each portion of the wall surface 568, and the respective closest portion of the radially inner surface of the slot 530, form a continuous surface in which lines in the axial direction extend continuously on both the portion of the wall surface 568 and the respective closest portion of the inner surface of the slot 530.

Each slot 530 is for receiving a respective vane 7. The vanes 7 and the corresponding slot surfaces, are formed with conformal portions as illustrated in FIG. 5 and FIG. 6.

The turbo-charger of the second embodiment is of a type in which the radially outer surfaces of the slot and vane are the high pressure side, and the radially inner surfaces are the suction side. In use, when a vane 7 is received in the slot 530, the ridge element 560 is on the side of the vane 7. The wall surface 568 faces towards the vane inner surface, and the portion of the slot surface closest to the wall surface 568 is the slot inner surface (the suction surface). The flow of the gas generates forces on various surfaces of the shroud 506. In particular, compared to the conventional shroud 6 of FIG. 3, a rotational force is developed on the wall surface 568 which urges the shroud 506 to rotate in the anti-clockwise direction as viewed in FIG. 11(*a*), as indicated by the large arrow. A simulation we performed showed that a rotational force on the shroud 506 in the anti-clockwise direction existed even in the absence of the ridge elements 560, but the rotational force was about 38% greater as a result of the ridge elements 560 when the vane 7 is in a central position within the slot 530. When the ridge elements are in this position, the efficiency of the turbine only slightly increased (by less than 1%) relative to the known shroud. However, the force urges the slots 530 and vanes 7 to adopt an arrangement as illustrated in FIG. 5 or FIG. 6. That is, due to the ridge elements 560, the respective conformal portions of the vane 7 and slot 530, are urged together, so as to inhibit, or even prevent, flow of the gas between them. In one of these two positions, the efficiency of the second embodiment would be significantly higher than if the ridge element 560 is not present.

Turning to FIG. 12(*a*), a shroud 606 is shown of a third embodiment of the disclosure. This third embodiment is again a turbocharger with the general form of FIG. 1, and elements of the embodiment other than the shroud 606, and its coupling to the turbine housing, are identical to the known turbocharger of FIG. 1, and therefore will be referred here by the same respective reference numerals. In particular, the nozzle ring 5 of the turbocharger may be as shown in FIG. 2, and is arranged for axial motion under the control of an actuator 16 as illustrated in FIG. 1. Like the shroud 6 of the known turbocharger of FIG. 1, the shroud 606 of the third embodiment is mounted in the turbine housing 1 in such a way that it is maintained at a fixed axial position (the same position illustrated in FIG. 1), and with its overall plane held perpendicular to the rotational axis 100. However, as in the second embodiment of the disclosure, the coupling between the shroud 606 and the turbine housing 1 permits the shroud 606 to rotate freely about the rotation axis 100 of the turbine wheel. Its rotation is limited only by interaction with the vanes of the nozzle ring.

The shroud 606 is viewed in FIG. 12(*a*) in a perspective view, looking at its face which, in use, is away from the nozzle ring 5. It is formed with a land surface 612 which is planar and transverse to the axis 100. The land surface 612 is formed with plurality of slots 630 which are through-holes. The land surface 612 extends between an outer rim 663 and an inner rim 664. Each of the slots 630 is defined by (i.e. has an edge which is) an inwardly-facing surface which at all points contains the axial direction 100. In other words, the slot 630 has longitudinal symmetry in the axial direction.

The outer rim 663 is typically where the shroud 606 is coupled to the turbine housing 1. The outer rim 663 may, for example, be trapped in a toroidal space defined between a circular surface of the turbine housing 1 and a toroidal plate (not shown) mounted to the turbine housing 1, such that the outer rim 663 is able to rotate in the toroidal space about the rotational axis 100.

FIG. 12(*b*) is a view of a portion of the shroud 606 in the axial direction, looking towards the nozzle ring, and FIGS. 12(*c*) and 12(*d*) are perspective views of respective portions of the same face of the shroud 606 from different respective directions. They show that each slot 630 is provided with a respective ridge element 631 which is upstanding from the land surface 612 in the axial direction away from the nozzle ring 5. The ridge element 631 extends along a portion of the edge of the slot 630. The ridge element 631 is elongate and curved. At an outer end it joins the outer rim 663, and at an inner end it joins the inner rim 664. Thus, the ridge elements 631 partition the land surface 612 into respective portions, one for each slot 630.

Looking along an extension direction of the ridge element 631, the ridge element 631 has a rectangular form. It is defined between two wall surfaces 632, 633 which each include at all points the axial direction 100, and a top surface which is transverse to the axial direction 100. The wall surface 633 is on the side of the ridge element 631 facing towards the slot 630. Each part of the wall surface 633 which is towards the slot 630 is flush with the closest portion of the inner surface of the slot 630, i.e. each portion of the wall surface 633, and the respective closest portion of the inner surface of the slot 630, form a continuous surface in which lines in the axial direction extend continuously on both the portion of the wall surface 633 and the respective closest portion of the inner surface of the slot 630.

Each slot 630 is for receiving a respective vane 7. The vanes 7 and the corresponding slot surfaces, are formed with conformal portions as illustrated in FIG. 5 or FIG. 6.

The turbo-charger of the third embodiment is of a type in which the radially inner surfaces of the slot and vane are the suction (low pressure) side, and the radially outer surfaces are on the high pressure side. In use, when a vane 7 is received in the slot 630, the ridge element 631 is on the low pressure side of the vane 7. The wall surface 633 faces towards the vane inner surface, and the portion of the slot surface closest to the wall surface 633 is the slot inner surface. The slot outer surface 635 is the pressure surface.

The flow of the gas generates forces on various surfaces of the shroud 606. In particular, compared to the conventional shroud 6 of FIG. 3, a greater net rotational force (torque) is developed which urges the shroud 606 to rotate in the anti-clockwise direction as viewed in FIG. 12(*a*), as indicated by the large arrow. Positive (anti-clockwise) torques are developed on the slot pressure surface 635, the outer rim 663, and the wall surface 632. These are greater than negative torques on the wall surface 633, the slot suction surface and the shroud plate extended fine 634. The net torque urges the slots 630 and vanes 7 to adopt an arrangement as illustrated in FIG. 5 or FIG. 6. That is, due to the ridge elements 631, the respective conformal portions of the vane 7 and slot 630, are urged together, so as to inhibit, or even prevent, flow of the gas between them. Simulations we performed showed that the net torque on the shroud is about 67% higher than in a known shroud as shown in FIG. 3. This comparison is performed when the vanes are in a central position within the slot. Accordingly, the rotational force on the shroud 606 is significantly greater than for the shroud 506 of the first embodiment. Even in this position, the efficiency of the embodiment is about 1% higher than with the conventional shroud.

When the vanes are at an angular position as shown in FIG. 5 or FIG. 6, the simulation showed the torque being 81% higher. and the efficiency of the turbine was 5.9% higher.

Turning to FIG. 13, shrouds of six further embodiments of the disclosure are shown in FIGS. 11(*a*)-(*f*) respectively. All these embodiments are turbochargers of the "moving shroud" type, in which an actuator (not shown) is mounted on the turbine housing (not shown) to translate the shroud axially. This actuator replaces the actuator 16 of the turbocharger of FIG. 1. It is known for the actuator of a turbocharger of the "moving shroud" type to be connected to the shroud by an arrangement resembling FIG. 2. That is, the shroud is mounted on guide rods using a bracket (foot) similar to the bracket 33. The axial position of the guide rods is controlled by the actuator.

FIG. 13(*a*) illustrates the shroud of a fourth embodiment of the disclosure. The shroud has the same appearance as a shroud of a conventional "moving shroud" turbine, including a number of slots 730 for receiving vanes (not shown). The radially inner side of each slot 730 is the low pressure surface. However, in the embodiment of FIG. 13(*a*), in contrast to a known "moving shroud" turbine, a coupling mechanism (not shown) is provided between the actuator and the shroud to permit the shroud to rotate about the circumferential axis of the turbine, i.e. perpendicular to face 708, which faces towards the nozzle ring. Although this coupling mechanism is not shown, it may resemble the coupling of FIG. 8, in which the bracket which conventionally connects a moving shroud to the guide rods is replaced by a bracket resembling the bracket 433 of FIG. 8.

Furthermore, in the embodiment of FIG. 13(*a*), the lateral surfaces of the vanes (not shown) and the slots 730 are formed with opposed conformal portions as illustrated in any of FIGS. 5 to 7.

FIG. 13(*b*) shows the shroud of a fifth embodiment of the disclosure. The shroud is viewed looking towards a face of the shroud which faces away from the nozzle ring. The face includes a land surface 710. The embodiment of FIG. 13(*b*) is identical to the embodiment of FIG. 13(*a*) (and accordingly corresponding elements are given the same reference numerals), except that as illustrated in FIG. 13(*b*) a ridge element 711 is provided along an edge of the slot 730, upstanding from the land surface 710.

FIG. 13(*c*) shows the shroud of a sixth embodiment of the disclosure. The embodiment of FIG. 13(*c*) is identical to the embodiment of FIG. 13(*a*) (and accordingly corresponding elements are given the same reference numerals), except that as illustrated in FIG. 13(*c*) a loop-like ridge element 712 is provided around the entire edge of the slot 730, upstanding from the face 708 (which can be considered as a land surface).

FIG. 13(*d*) shows the shroud of a seventh embodiment of the disclosure. The embodiment of FIG. 13(*d*) is identical to the embodiment of FIG. 13(*a*) (and accordingly corresponding elements are given the same reference numerals), except that as illustrated in FIG. 13(*d*) a loop-like ridge element 713 is provided around the entire edge of the slot 730, upstanding from the land surface 710 which faces away from the nozzle ring.

FIG. 13(*e*) shows the shroud of a eighth embodiment of the disclosure. The embodiment of FIG. 13(*e*) is identical to the embodiment of FIG. 13(*a*) (and accordingly corresponding elements are given the same reference numerals), except that as illustrated in FIG. 13(*e*) the shroud includes a number of blades 714, which are arranged to provide a "waterwheel" arrangement. The blades 714 are gas interaction elements, which develop a rotational force on the shroud due to gas flow in the recess on the side of the shroud opposite the nozzle ring.

FIG. 13(*f*) shows the shroud of a ninth embodiment of the disclosure. The embodiment of FIG. 13(*f*) is identical to the embodiment of FIG. 13(*a*) (and accordingly corresponding elements are given the same reference numerals), except that as illustrated in FIG. 13(*d*) a ridge element 715 is provided along a radially inward edge of the slot 730, upstanding from the land surface 710 which faces away from the nozzle ring. The radially outer end of the slot curls around a radially outer end of the slot 730.

In simulations, we have demonstrated that gas flow in all these embodiments develops a positive torque, where the positive direction is the anti-clockwise direction as viewed on FIG. 13(*a*) (i.e. the clockwise direction viewed from the turbine end). This positive torque would tend to produce a vane-slot arrangement as illustrated in FIG. 5 or FIG. 6, with the radially inner side of the slot 730 pressed against the radially inner side of the vane.

However, the embodiment of FIG. 13(*b*) produces a less positive torque than the embodiment of FIG. 13(*a*), and the embodiments of FIG. 13(*c*) and FIG. 13(*e*) are only slightly more positive than the embodiment of FIG. 11(*a*). In the case of the embodiment of FIG. 13(*e*) this is because the blades 714 are in a position in which the gas flow tends to be slow. By contrast, the embodiment of FIG. 13(*d*) produces a positive torque which is about 75% higher than the embodiment of FIG. 13(*a*), due to a high pressure difference, on the radially inward side of the loop-like ridge element 713, between the inwardly facing surface of the ridge element 713 (a low pressure position) and the opposite outwardly-facing wall surface of the ridge element 713.

The embodiment of FIG. 13(*f*) produces a positive torque approximately twice that of the embodiment of FIG. 13(*a*). This is because the ridge element 715 has the same surfaces as the ridge element 713 of embodiment of FIG. 13(*d*) but without the radially-outer portion of the loop-shaped ridge element (i.e. without a portion which corresponds to the ridge element 711 of FIG. 13(*b*) which, as noted above, tends to reduce the positive torque). Thus, it can be concluded that ridge elements at the suction side of these embodiments were most effective in generating torque in the desired clocking direction.

In simulations, we have investigated the effect of providing, in variants of the embodiment of FIG. 13(*f*), a circumferential spacing between the radially inner wall surface of the ridge element 715 and the closest portion of the slot inner surface. In the embodiment of FIG. 13(*f*) there is no such spacing (i.e. the radially outer wall surface of the ridge element 715 is simply an extension of the slot inner surface), but in these variants the ridge element 715 was displaced in the anti-clockwise direction as viewed in FIG. 13(*f*) by different degrees. In other words, a portion of the land surface 710 was provided between the slot 730 and the ridge element 715. It was found that the greater the spacing, the more the torque was reduced. It can be concluded that maximum torque is produced when the radially-outer wall surface of the ridge element 715 is substantially flush with (i.e. a continuous axial extension of) the closest portion of the inwardly-facing slot surface (in this case, the slot inner surface).

What is claimed is:

1. A turbine comprising: (i) a turbine wheel having an axis, (ii) a turbine housing for defining a chamber for receiving the turbine wheel for rotation of the turbine wheel about the axis, the turbine housing further defining a gas inlet, and an annular inlet passage from the gas inlet to the chamber, (iii) a ring-shaped shroud defining a plurality of slots and encircling the axis; and (iv) a nozzle ring supporting a plurality of vanes which extend from the nozzle ring parallel to the axis, and project through respective ones of the slots; the shroud and nozzle ring being positioned on opposite sides of the inlet passage and rotatable relative to each other about the axis by an angular amount of at least 0.1 degrees; the nozzle ring being rotatable relative to the turbine housing about the axis by at least 0.1 degree.

2. The turbine according to claim 1 in which the shroud is angularly rotatable about the axis with respect to the turbine housing by an amount less than 0.1 degree.

3. The turbine according to claim 1 in which the nozzle ring and shroud are relatively rotatable about the axis of the turbine by at least 0.3 degrees.

4. The turbine according to claim 1, further comprising an actuator for displacing one of the nozzle ring or shroud axially with respect to the other, the actuator being mounted on the turbine housing and coupled to the one of the nozzle ring and shroud by a coupling mechanism which permits relative rotation of the one of the nozzle ring or shroud with respect to the actuator about the axis by at least 0.1 degree.

5. The turbine according to claim 4 in which the coupling mechanism includes at least one guide coupling, each guide coupling including: (i) a first element fast with either the actuator or the nozzle ring, and (ii) a second element fast with the other of the actuator or the nozzle ring, and being arranged to move within a limited region defined by the first element, the region being sized to permit the second element to rotate circumferentially about the axis relative to the first element by at least 0.1 degrees.

6. The turbine according to claim 5 in which the first element defines at least one control surface extending in a circumferential direction about the axis, and the second element is arranged to move along a path defined by the control surface.

7. The turbine according to claim 1 in which the shroud is retained on the turbine housing, and the turbine comprises a limit element which bears against a circumferentially-facing surface of the shroud and limits rotation of the shroud about the axis.

8. The turbine according to claim 7 in which the limit element is provided as a pin element which projects from the turbine housing, the shroud having a wall defining a gap containing the pin element.

9. The turbine according to claim 8 in which the pin element includes a substantially flat surface for limiting motion of an opposing surface of the shroud.

10. The turbine according to claim 1 in which the shroud is rotatable relative to the turbine housing about the axis by at least 0.1 degree, and the shroud comprises a plurality of gas interaction elements upstanding from a land surface of a face of the shroud, each gas interaction element including at least one wall surface arranged to develop a rotational force in use due to flow of the gas against the gas interaction element.

11. The turbine according to claim 10 in which the face of the shroud is opposite to the nozzle ring.

12. The turbine according to claim 10, in which each gas interaction element is provided proximate to an edge of a respective one of the slots.

13. The turbine according to claim 12 in which, in use, each gas interaction element is proximate a suction portion of a slot surface of the respective slot, and defines a wall surface facing towards the respective slot and a wall surface facing away from the respective slot.

14. The turbine according to claim 13 in which no gas interaction element is provided proximate an edge of one of the slots which, in use, is a high pressure portion of the slot surface.

15. The turbine according to claim 10 in which each gas interaction element includes a wall surface which is an axial extension of a portion of an inwardly-facing surface of the slot.

16. The turbine according to claim 10 in which each gas interaction element is elongate.

17. The turbine according to claim 10 in which ridge elements are connected together by rib elements upstanding from the face of the shroud.

18. The turbine according to claim 1, wherein each of the vanes is spaced from the axis by a nozzle radius; each of the slots having an inwardly-facing slot surface, and each of the vanes having: an axially-extending vane surface which includes (i) a vane outer surface facing an outer surface of the corresponding slot, and (ii) an opposed vane inner surface facing an inner surface of the corresponding slot, and a median line between the vane inner surface and the vane outer surface extending from a first end of the vane to a second end of the vane; the vane surface including a conformal portion, extending along at least 15% of the length of the median line, and facing a corresponding conformal portion of the slot surface, wherein, at room temperature, the respective profiles of the conformal portion of the vane surface and the conformal portion of the slot surface diverge from each other by no more than 0.35% of the nozzle radius.

19. The turbine according to claim 1 in which the shroud is retained on the turbine housing, the turbine further comprising an annular retaining ring provided on a radially-inward edge of the shroud, the retaining ring being positioned to obstruct gas from passing into the inlet passage from a side of the shroud away from the inlet passage.

20. A turbocharger comprising a turbine comprising: (i) a turbine wheel having an axis, (ii) a turbine housing for defining a chamber for receiving the turbine wheel for rotation of the turbine wheel about the axis, the turbine housing further defining a gas inlet, and an annular inlet passage from the gas inlet to the chamber, (iii) a ring-shaped shroud defining a plurality of slots and encircling the axis; and (iv) a nozzle ring supporting a plurality of vanes which extend from the nozzle ring parallel to the axis, and project through respective ones of the slots; the shroud and nozzle ring being positioned on opposite sides of the inlet passage and rotatable relative to each other about the axis by an angular amount of at least 0.1 degrees; the nozzle ring being rotatable relative to the turbine housing about the axis by at least 0.1 degree.

* * * * *